US012569954B2

(12) United States Patent
Hasegawa

(10) Patent No.: US 12,569,954 B2
(45) Date of Patent: Mar. 10, 2026

(54) POLISHING APPARATUS, POLISHING METHOD, AND CLEANING LIQUID SUPPLY DEVICE

(71) Applicant: MEINAN MACHINERY WORKS, INC., Aichi (JP)

(72) Inventor: Yasumasa Hasegawa, Obu (JP)

(73) Assignee: MEINAN MACHINERY WORKS, INC., Aichi (JP)

( * ) Notice: Subject to any disclaimer, the term of this patent is extended or adjusted under 35 U.S.C. 154(b) by 558 days.

(21) Appl. No.: 17/775,654

(22) PCT Filed: Sep. 15, 2020

(86) PCT No.: PCT/JP2020/034815
§ 371 (c)(1),
(2) Date: May 10, 2022

(87) PCT Pub. No.: WO2021/106321
PCT Pub. Date: Jun. 3, 2021

(65) Prior Publication Data

US 2022/0402088 A1 Dec. 22, 2022

(30) Foreign Application Priority Data

Nov. 27, 2019 (JP) ..... 2019-214333

(51) Int. Cl.
*B24B 21/14* (2006.01)

(52) U.S. Cl.
CPC ..... *B24B 21/14* (2013.01)

(58) Field of Classification Search
CPC ..... B24B 21/00; B24B 21/04; B24B 21/12; B24B 21/14; B24B 21/20; B24B 21/22
See application file for complete search history.

(56) References Cited

U.S. PATENT DOCUMENTS 2,567,589 A * 9/1951 Alvord ..... B24B 55/02 451/450
3,812,622 A * 5/1974 Parsons ..... B24B 21/18 451/442

(Continued)

FOREIGN PATENT DOCUMENTS

JP S49-003438 B1 1/1974
JP S51-012158 B2 4/1976

(Continued)

OTHER PUBLICATIONS

International Search Report issued in PCT/JP2020/034815; mailed Dec. 1, 2020.

*Primary Examiner* — Joel D Crandall
*Assistant Examiner* — Jason Khalil Hawkins
(74) *Attorney, Agent, or Firm* — Studebaker Brackett PLLC

(57) ABSTRACT

Cleaning water CW is supplied to the outer surface of a draining roll 10 from a pipe 70 arranged above the draining roll 10 that is in pressure contact with a contact roll 8 via a polishing belt PB. Accordingly, the cleaning water CW adheres evenly to the outer surface of the draining roll 10 in the longitudinal direction along with the rotation of the draining roll 10. Then, the cleaning water CW sufficiently adhering to the outer peripheral surface of the draining roll 10 is carried to a contact portion 90 between the draining roll 10 and the polishing belt PB, and cleans the abrasive surface of the polishing belt PB. As a result, it is possible to well reduce the occurrence of uneven cleaning on the abrasive surface, and to further improve the polishing effects of a polishing apparatus 1.

15 Claims, 13 Drawing Sheets

(56) References Cited

U.S. PATENT DOCUMENTS

| | | | | |
|---|---|---|---|---|
| 5,533,244 | A * | 7/1996 | Wadzinski | D21G 1/00 29/90.01 |
| 6,243,934 | B1 * | 6/2001 | Wadzinski | D21G 1/00 29/90.1 |
| 2004/0203327 | A1 * | 10/2004 | Hacikyan | B24B 55/02 451/178 |
| 2018/0297171 | A1 * | 10/2018 | Zhao | B24B 53/10 |

FOREIGN PATENT DOCUMENTS

| | | | |
|---|---|---|---|
| JP | S64-000185 | B2 | 1/1989 |
| JP | H08-019963 | A | 1/1996 |
| JP | H11-188629 | A | 7/1999 |

* cited by examiner

POLISHING APPARATUS, POLISHING METHOD, AND CLEANING LIQUID SUPPLY DEVICE

FIELD

The present invention relates to a polishing apparatus and a polishing method for polishing a processed material with an endless abrasive belt, and a cleaning liquid supply device for supplying a cleaning liquid to the polishing apparatus.

BACKGROUND

Japanese Examined Patent Publication No. 51-12158 (Patent Document 1) describes a polishing apparatus for polishing a processed material with a rotating endless abrasive belt. The polishing apparatus includes a pressure-contact roll to be in pressure-contact with an abrasive surface of the abrasive belt, a backup roll arranged on the opposite side of the abrasive belt from the pressure-contact roll so as to be in pressure-contact with the pressure-contact roll via the abrasive belt, and a cleaning liquid supply device having multiple nozzles capable of supplying a cleaning liquid to the abrasive belt. Here, the pressure-contact roll and the backup roll are arranged downstream in the rotation direction of the abrasive belt with respect to the polishing processing position where the abrasive belt polishes the processed material. The cleaning liquid supply device is disposed upstream in the rotation direction of the abrasive belt with respect to the pressure-contact portion between the pressure-contact roll and the abrasive belt. Further, the plurality of nozzles is disposed along the extending direction of the pressure-contact roll, the abrasive belt, and the pressure-contact portion.

The polishing apparatus directly supply the cleaning liquid to the abrasive belt so as to decrease clogging in the abrasive belt and generation of frictional heat during polishing. In addition, the polishing apparatus removes the cleaning liquid stuck on the abrasive belt by using the pressure-contact roll so as to avoid the cleaning liquid from adhering to the processed material.

CITATION LIST

Patent Literature

Patent Document 1: Japanese Examined Patent Publication No. 51-12158

SUMMARY

Technical Problem

However, in the polishing apparatus described in the above-mentioned publication, the cleaning liquid hits differently at the abrasive surface of the abrasive belt that passes the positions facing the plurality of nozzles and at the abrasive surface of the abrasive belt that passes the positions located between the plurality of nozzles. As a result, uneven cleaning may occur on the abrasive surface. Further, the polishing apparatus described in the above-mentioned publication requires a relatively large discharge pressure and discharge amount of the liquid in order to cause the cleaning liquid to collide with the abrasive surface.

The present invention has been made in view of the above problems, and one of the objectives of the present invention is to provide a polishing apparatus and a polishing method that contribute to further improvement of polishing effects with a simple configuration. Another objective of the present invention is to provide a polishing apparatus and a polishing method that contribute to downsizing the apparatus. Further, another objective of the present invention is to provide a polishing apparatus and a polishing method that contribute to the improvement of economic efficiency. Furthermore, another objective of the present invention is to provide a cleaning liquid supply device that contributes to the improvement of cleaning effect of the abrasive belt.

Solutions to Problem

A polishing apparatus, a polishing method, and a cleaning liquid supply device of the present invention have adopted the following means to achieve the above-mentioned objectives.

According to a preferred embodiment of the polishing apparatus according to the present invention, a polishing apparatus is configured for polishing a processed material by rotating an endless abrasive belt including an abrasive surface. The polishing apparatus includes a frame body, a first roll, a second roll, and a cleaning liquid supply pipe. The first roll is rotatably supported by the frame body so as to be in pressure-contact with the surface opposite to the abrasive surface. The second roll is disposed to be parallel to the first roll and face the abrasive surface, and is rotatably supported by the frame body so as to be in pressure-contact with the first roll via the abrasive belt. The cleaning liquid supply pipe has at least one discharge port for discharging a cleaning liquid and is supported by the frame body such that the discharge port faces the outer surface of the second roll.

According to the present invention, the cleaning liquid supplied from the discharge port to the outer surface of the second roll is supplied to the abrasive surface of the abrasive belt via the second roll. Here, the cleaning liquid discharged to the outer surface of the second roll spreads planarly over the outer surface of the second roll, and thereby the cleaning liquid can be supplied to a wide area of the abrasive surface. Thus, it is possible to well reduce the occurrence of uneven cleaning on the abrasive surface. As a result, the polishing effects of the polishing apparatus can be further improved. Since the improvement is achieved only by supplying the cleaning liquid from the discharge port to the outer surface of the second roll, the configuration is simple. As a prerequisite, the cleaning liquid supplied to the abrasive surface is well prevented from passing through the pressure-contact portion between the first roll and the second roll by the pressure-contact between the first roll and the second roll via the abrasive belt. Accordingly, it is possible to well prevent the abrasive belt that has some cleaning liquid stuck thereon from polishing a processed material.

According to another embodiment of the polishing apparatus according to the present invention, the discharge port is disposed above the second roll in the vertical direction, and also within a projection area of the second roll in a virtual projection plane when the second roll is viewed from above in the vertical direction.

According to the present embodiment, since the cleaning liquid can be supplied to the abrasive surface of the abrasive belt only by dropping the cleaning liquid from the discharge port, the cleaning liquid can be applied with smaller discharge pressure and amount as compared with the configuration in which the cleaning liquid is sprayed onto the second roll. As a result, the capacity of the pump for supplying the cleaning liquid can be smaller than that of the configuration in which the cleaning liquid is sprayed onto the second roll, and the pump can be downsized. In addition, the amount of cleaning liquid used can be reduced, and thereby economic efficiency can be improved.

According to another embodiment of the polishing apparatus according to the present invention, the polishing apparatus further includes a support frame arranged on the frame body so as to be movable in a direction toward and away from the first roll, and a first actuator mechanically connected to the support frame so as to move the support frame in the direction toward and away from the first roll. The second roll is rotatably supported by the support frame.

According to the present embodiment, a configuration can be achieved easily in which the second roll is pressed against and contacted with the first roll via the abrasive belt only when the abrasive belt needs to be cleaned.

According to another embodiment of the polishing apparatus according to the present invention, the polishing apparatus further includes a plate extending in the axial centerline direction of the second roll. The plate has a tip portion that is in contact with the outer surface of the second roll along the axial centerline direction of the second roll. The plate is disposed downstream in the rotation direction of the second roll with respect to a position of the projection of the discharge port in the virtual projection plane. Further, the tip portion of the plate has a plurality of notches. The plurality of notches is evenly arranged in the extending direction of the plate.

According to the present embodiment, a part of the cleaning liquid supplied from the discharge port to the outer surface of the second roll can be temporarily stored in the region defined by the plate and the outer surface of the second roll. Then, the stored cleaning liquid flows out downstream in the rotation direction of the second roll from the plurality of notches evenly arranged in the extending direction of the plate. Accordingly, the cleaning liquid almost uniformly adheres to the outer surface of the second roll, and the cleaning liquid can be supplied to a wide area of the abrasive surface. As a result, it is possible to further reduce the occurrence of uneven cleaning on the abrasive surface.

According to another embodiment of the polishing apparatus according to the present invention which includes the support frame movable in the direction toward and away from the first roll, the cleaning liquid supply pipe is supported by the support frame.

According to the present embodiment, the second roll and the cleaning liquid supply pipe can be integrated as a unit.

According to another embodiment of the polishing apparatus according to the present invention which includes the support frame movable in the direction toward and away from the first roll, the plate is supported by the support frame.

According to the present embodiment, the second roll and the plate can be integrated as a unit.

According to another embodiment of the polishing apparatus according to the present invention, the polishing apparatus further includes a third roll and a second actuator. The third roll is disposed to be parallel to the first and second rolls and to be in pressure-contact with the surface opposite to the abrasive surface of the belt. The third roll is also rotatably supported by the frame body. The second actuator is mechanically connected to at least one of the first and third rolls for rotating at least one of the first and third rolls. As such, by rotating at least one of the first and third rolls, the second actuator rotates the abrasive belt that is wound around the first and third rolls.

According to the present embodiment, the first and third rolls around which the abrasive belt is wound are used as backup rolls for the second roll, and thereby the number of components can be reduced as compared with a configuration in which a dedicated roll only for backing up the second roll is used.

According to another embodiment of the polishing apparatus according to the present invention, the polishing apparatus further includes a third actuator mechanically connected to the third roll. Here, the first roll is a contact roll that is able to be in pressure-contact with a processed material via the abrasive belt. The third roll is supported by the frame body so as to be movable in the direction toward and away from the first roll. The third actuator is able to move the third roll in the direction toward and away from the first roll.

According to the present embodiment, the tension of the abrasive belt can be adjusted by moving the third roll in the direction toward and away from the first roll. In this configuration, since the third roll moves, the second roll cannot be pressed against and contacted with the third roll, and the second roll needs to be brought into pressure contact with the first roll. In this case, the space between the second roll and a processed material becomes narrow, making it difficult to arrange the cleaning liquid supply device in the space. That is, it becomes difficult to clean the abrasive belt using a conventional cleaning liquid supply device that is configured to directly supply a cleaning liquid to the abrasive belt. However, according to the present embodiment, supplying the cleaning liquid to the outer surface of the second roll is all that is needed, which eliminates the arrangement of the cleaning liquid supply device in the narrow space. This improves the degree of freedom in arranging the cleaning liquid supply device.

According to another embodiment of the polishing apparatus according to the present invention, the polishing apparatus further includes a fourth actuator mechanically connected to the third roll. Here, the first roll is a contact roll that is able to be into pressure-contact with a processed material via an abrasive belt. The third roll is supported by the frame body such that one end thereof in the longitudinal direction is movable in a first direction that is orthogonal to both the longitudinal direction and the vertical direction. The fourth actuator is able to move, in the first direction, one end of the third roll in the longitudinal direction.

According to the present embodiment, by moving the third roll in the first direction, the positional displacement of the abrasive belt in the longitudinal direction of the first and third rolls can be corrected with respect to the first and third rolls. In this configuration, since one end of the third roll in the longitudinal direction is moved in the first direction, the second roll cannot be pressure against and contacted with the third roll, and the second roll needs to be brought in pressure-contact with the first roll. In this case, the space between the second roll and the processed material becomes narrow, making it difficult to arrange the cleaning liquid supply device in the space. That is, it becomes difficult to clean the abrasive belt using a conventional cleaning liquid supply device that is configured to directly supply a cleaning liquid to the abrasive belt. However, according to the present embodiment, supplying the cleaning liquid to the outer surface of the second roll is all that is needed, which eliminates the arrangement of the cleaning liquid supply device in the narrow space. This improves the degree of freedom in arranging the cleaning liquid supply device.

According to another embodiment of the polishing apparatus according to the present invention, the third roll is supported by the frame body via a self-aligning bearing. The fourth actuator is connected to the third roll via the self-aligning bearing.

According to the present embodiment, the self-aligning bearing can correct the misalignment between the axis centerline and the rotation axis of the third roll caused by the movement, in the first direction, of one end of the third roll in the longitudinal direction.

According to another embodiment of the polishing apparatus according to the present invention, the third roll is disposed above the first roll in the vertical direction.

According to the present embodiment, it is possible to prevent the polishing apparatus from increasing in size in the transport direction of a processed material and the direction orthogonal to both the transport direction and the vertical direction.

According to another embodiment of the polishing apparatus according to the present invention, the polishing apparatus further includes a cleaning liquid tray disposed, in the vertical direction, below a contact portion between the second roll and the abrasive surface.

According to the present embodiment, the cleaning liquid tray receives the cleaning liquid that has finished cleaning the abrasive surface of the abrasive belt.

According to another embodiment of the polishing apparatus according to the present invention, the polishing apparatus further includes air nozzles each having an air discharge opening directed to the center, in the extending direction, of the contact portion between the second roll and the abrasive surface. The air nozzles are arranged at both ends of the contact portion in the extending direction.

According to the present embodiment, the air discharged from the air nozzles can well decrease the cleaning liquid staying in the contact portion between the second roll and the abrasive surface of the abrasive belt and scattering to the outside of the contact portion.

According to another embodiment of the polishing apparatus according to the present invention, the outer surface of the second roll is covered with an elastic member.

According to the present embodiment, the elastic member can be elastically deformed to enter into between the abrasive grains on the abrasive surface of the abrasive belt, and at this time of point, the cleaning liquid can also enter into between the abrasive grains. This makes it possible to effectively clear the polishing debris residing between the abrasive grains. The cleaning liquid that has entered into between the abrasive grains is sufficiently scraped out by the elastic member that is elastically deformed to enter into between the abrasive grains, and thereby it is possible to effectively prevent the cleaning liquid from remaining on the abrasive surface of the abrasive belt.

According to a preferred embodiment of the polishing method according to the present invention, a polishing method for polishing a processed material is configured by rotating an endless abrasive belt having an abrasive surface. In the polishing method, (a) the abrasive belt is rotated, and (b) a second roll is brought into pressure-contact with a first roll via the abrasive belt, the second roll being disposed downstream in the rotation direction of the abrasive belt with respect to the pressure-contact portion between the abrasive surface of the abrasive belt and the processed material, wherein the abrasive belt has been wound around the first roll, (c) the cleaning liquid is supplied to the outer surface of the second roll, and (d) the second roll is pressed against and contacted with the first roll to remove the cleaning liquid stuck to the abrasive surface of the abrasive belt, and the abrasive belt is then pressed against and contacted with the processed material, so as to polish the processed material.

According to the present invention, the cleaning liquid is supplied to the outer surface of the second roll and then to the abrasive surface of the abrasive belt via the second roll. Here, since the cleaning liquid discharged to the outer surface of the second roll spreads planarly over the outer surface of the second roll, the cleaning liquid can be supplied to a wide area of the abrasive surface. Accordingly, it is possible to well reduce the occurrence of uneven cleaning on the abrasive surface. As a result, the polishing effects of the polishing apparatus can be further improved. Since the improvement is achieved only by supplying the cleaning liquid to the outer surface of the second roll, the configuration is simple. As a prerequisite, the cleaning liquid supplied to the abrasive surface is sufficiently prevented from passing the pressure-contact portion between the first and second rolls by the pressure-contact of the first and second rolls via the abrasive belt. Thus, it is possible to well prevent the abrasive belt that has some cleaning liquid stuck thereon from polishing the processed material.

According to a preferred embodiment of the cleaning liquid supply device according to the present invention, a cleaning liquid supply device for supplying a cleaning liquid to a polishing apparatus is configured. The polishing apparatus includes a frame body, a wound roll rotatably supported by the frame body such that an abrasive belt can be wound around the wound roll, and a pressure-contact roll rotatably supported by the frame body so as to be in pressure-contact with the wound roll via the abrasive belt. The cleaning liquid supply device includes a cleaning liquid supply pipe and a pump. The cleaning liquid supply pipe has at least one discharge port for discharging the cleaning liquid. Further, the cleaning liquid supply pipe is disposed such that the discharge port faces the outer surface of the pressure-contact roll. Furthermore, the pump is connected to the cleaning liquid supply pipe such that the cleaning liquid can be supplied to the cleaning liquid supply pipe.

According to the present invention, the cleaning liquid supplied to the outer surface of the pressure-contact roll is supplied to the abrasive surface of the abrasive belt via the pressure-contact roll. Here, since the cleaning liquid discharged to the outer surface of the pressure-contact roll spreads planarly on the outer surface of the pressure-contact roll, the cleaning liquid can be supplied to a wide area of the abrasive surface. Thus, it is possible to well reduce the occurrence of uneven cleaning on the abrasive surface. As a result, the polishing effects of the polishing apparatus can be further improved. Since the improvement is achieved only by supplying the cleaning liquid to the outer surface of the pressure-contact roll, the configuration is simple. As a prerequisite, the cleaning liquid supplied to the abrasive surface is sufficiently prevented from passing through the pressure-contact portion between the wound roll and the pressure-contact roll by the pressure-contact between the wound roll and the pressure-contact roll via the abrasive belt. It is possible to well prevent the abrasive belt that has some cleaning liquid stuck thereon from polishing the polishing of the processed material.

Advantageous Effects of the Invention

According to the present invention, the polishing effects can be further improved with a simple configuration of the polishing apparatus. In addition, downsizing of the apparatus can be achieved. Furthermore, it is possible to improve the economic efficiency.

DETAILED DESCRIPTION

Next, the best mode for carrying out the present invention will be described with reference to examples.

Example 1

Figure 1:
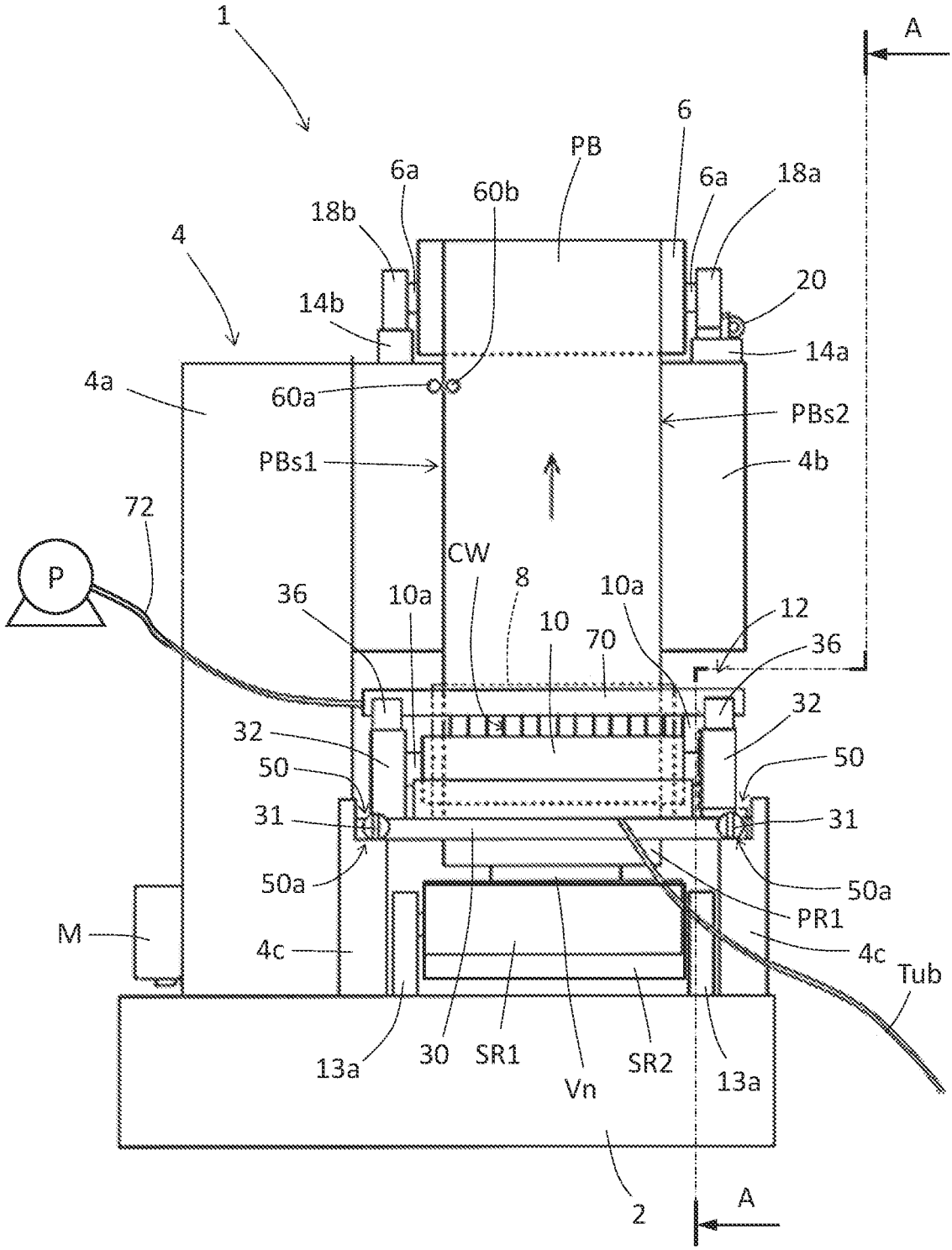
FIG. 1 is a schematic configuration diagram showing the outline of a configuration of a polishing apparatus 1 as a first example of the present invention.
Figure 2:
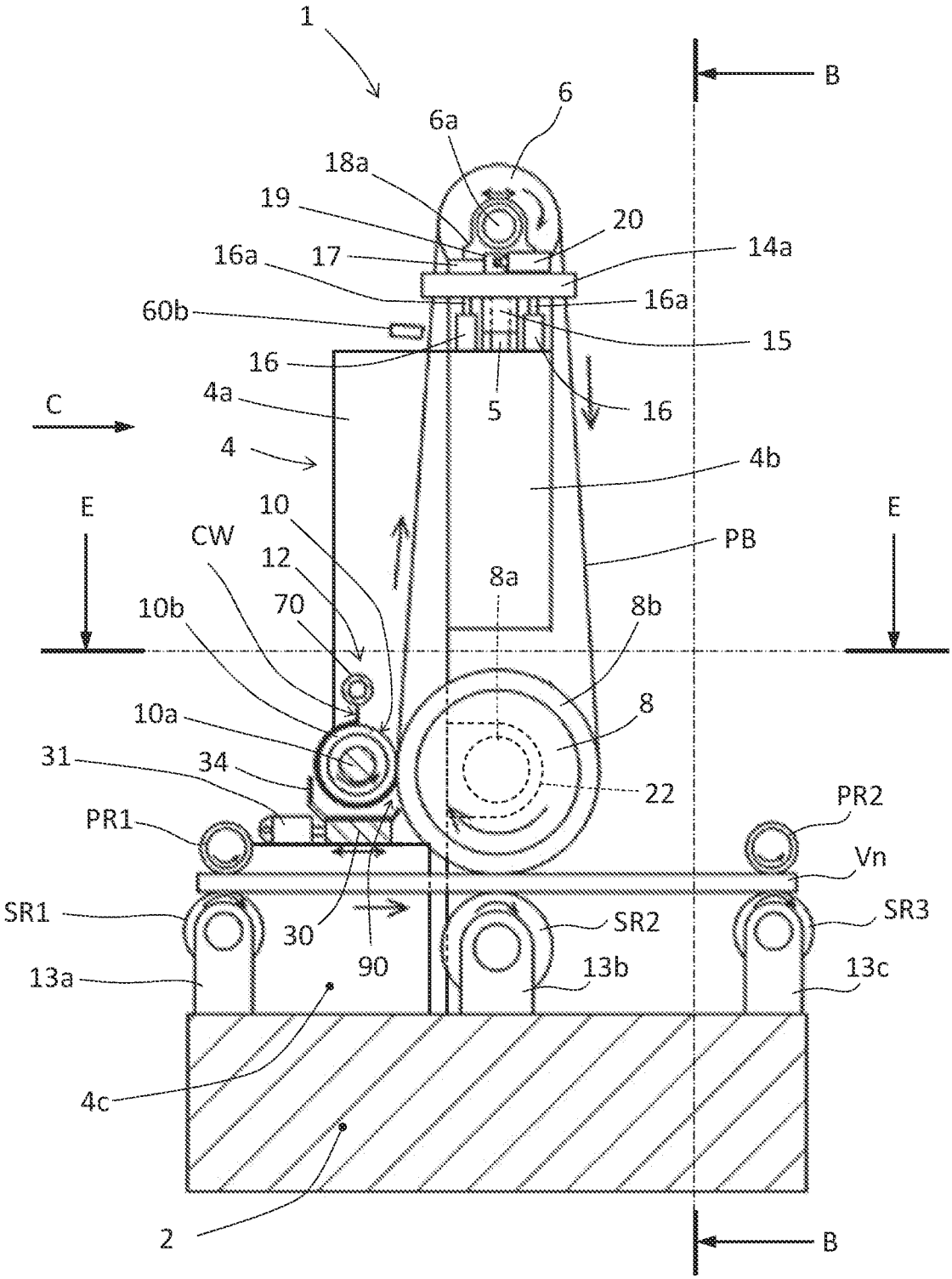
FIG. 2 is a cross-sectional view showing a cross section taken along the line A-A of FIG. 1.
Figure 3:
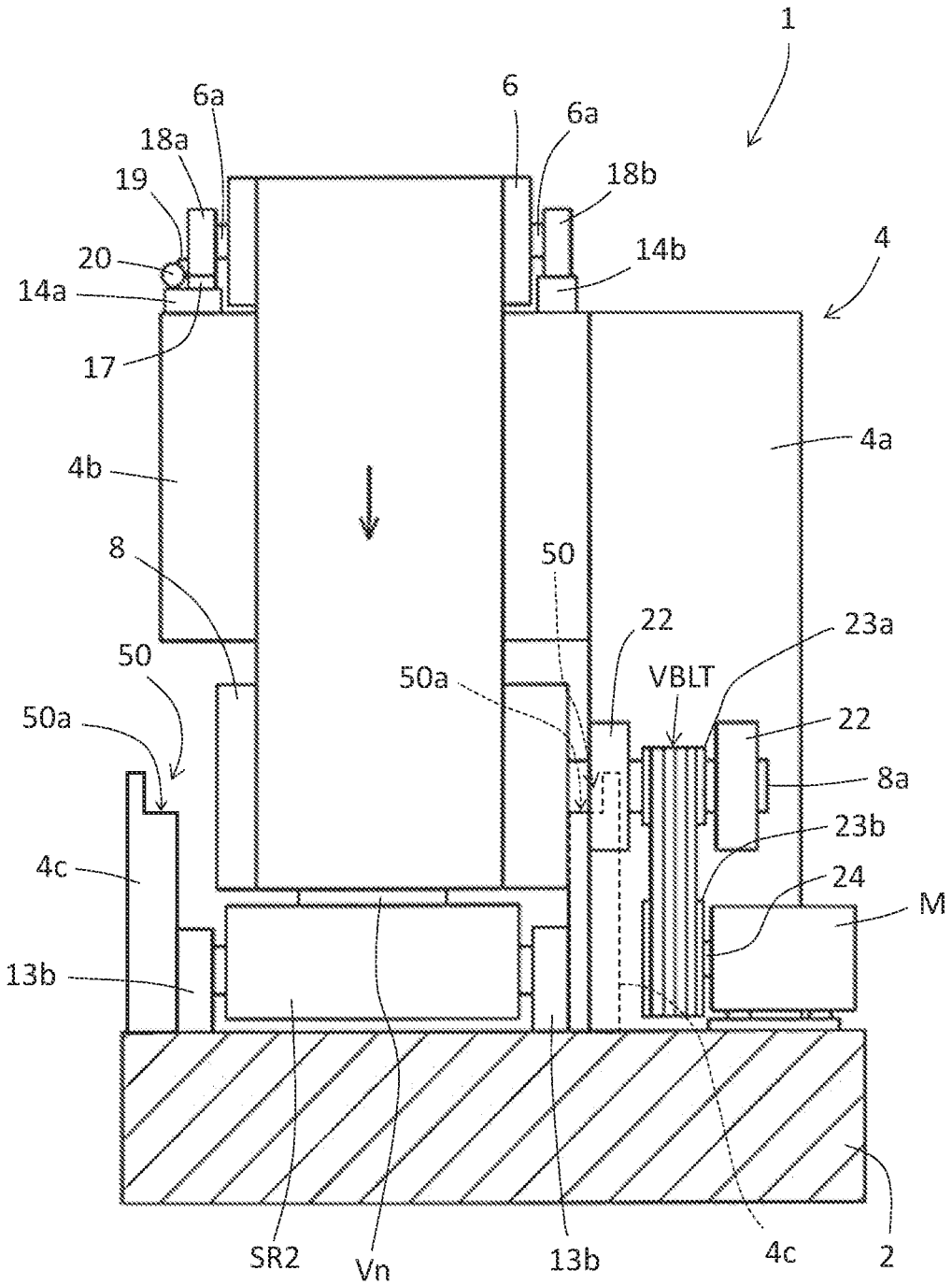
FIG. 3 is a cross-sectional view showing a cross section taken along the line B-B of FIG. 2.

As shown in FIGS. 1 to 3, a polishing apparatus 1 of a first example of the present invention mainly includes: a main frame 4 fixed on a bed 2, an upper roll 6 and a contact roll 8 rotatably supported by the main frame 4 (see FIGS. 2 and 3), a motor M connected to the contact roll 8 via a V-belt VBLT (see FIG. 3), a drain roll 10 arranged to face the contact roll 8 (see FIG. 2), a cleaning water supply device 12 disposed above the drain roll 10 in the vertical direction, a plurality of support rolls SR1, SR2, SR3 rotatably supported by bearings 13*a*, 13*b*, 13*c* fixed on the bed 2 (see FIG. 2), and press rolls PR1 and PR2 arranged to face the support rolls SR1 and SR3 (see FIG. 2). The polishing apparatus 1 polishes a surface of a processed material Vn such as plywood that is placed and conveyed on the support rolls SR1, SR2, and SR3, by rotating an endless abrasive belt PB wound around the upper roll 6 and the contact roll 8. Note that the abrasive belt PB is wound around the upper roll 6 and the contact roll 8 such that the abrasive surface is not pressed against and contacted with the upper roll 6 and the contact roll 8, that is, the abrasive surface faces outward. The motor M is an example of an implementation configuration corresponding to the "second actuator" in the present invention.

As shown in FIGS. 1 and 3, the main frame 4 includes: a main wall 4*a* extending vertically upward from the upper surface of the bed 2, a beam 4*b* connected to an extending end of the main wall 4*a* and extending in a direction orthogonal to the extending direction of the main wall 4*a*, and a pair of support walls 4*c* and 4*c* extending vertically upward from the upper surface of the bed 2. The main frame 4 is an example of an implementation configuration corresponding to the "frame body" in the present invention.

As shown in FIGS. 1 and 3, the main wall 4*a* and the beam 4*b* are in an inverted L-shape when viewed from one side of the transport direction of the processed material Vn such as plywood (the direction perpendicular to the paper surface of FIGS. 1 and 3). As shown in FIGS. 1 and 3, a pair of support bases 14*a* and 14*b* is disposed, on the upper surface of the beam 4*b*, separate from each other by a predetermined distance in the extending direction of the beam 4*b*. As shown in FIG. 2, the support bases 14*a* and 14*b* are connected to the piston rods 16*a* and 16*a* of air cylinders 16 and 16 attached to the upper surface of the beam 4*b* (in FIG. 2, only the support base 14*a* is shown). The air cylinders 16 and 16 are attached to the upper surface of the beam 4*b* such that the extension and retraction directions of the piston rods 16*a* and 16*a* are parallel to the vertical direction.

As shown in FIG. 2, a slide member 15 is integrally attached to the lower surfaces of the support bases 14*a* and 14*b* (in FIG. 2, only the support base 14*a* is shown). The slide member 15 is engaged with a guide member 5 integrally attached to the upper surface of the beam 4*b*. The guide member 5 extends in a direction parallel to the extension and retraction directions (vertical direction) of the piston rods 16*a* and 16*a*. With the configuration, the support bases 14*a* and 14*b* on the upper surface of the beam 4*b* move toward and away from the upper surface of the beam 4*b* (upward and downward in the vertical direction) in response to the extension and retraction of the piston rods 16*a* and 16*a* caused by the air cylinders 16 and 16. The air cylinders 16 and 16 are examples of an implementation configuration corresponding to the "third actuator" in the present invention.

As shown in FIGS. 1 to 3, the self-aligning ball bearings 18*a* and 18*b* are mounted to the upper surfaces of the pair of support bases 14*a* and 14*b*, respectively. As shown in FIG. 2, the self-aligning ball bearing 18*a* is connected to the support base 14*a* via a linear guide 17. More specifically, the self-aligning ball bearing 18*a* has a coupling 19 integrally attached thereto. To the coupling 19, a piston rod (not shown) of the air cylinder 20 fixed to the support base 14*a* is connected. Note that the air cylinder 20 is fixed to the support base 14*a* such that the extension and retraction direction of the piston rod (not shown) is parallel to both the vertical direction and the extending direction of the axis centerline of the self-aligning ball bearing 18*a* (the left-right direction in FIG. 2). With the configuration, when the piston rod (not shown) of the air cylinder 20 is extended or retracted, only the self-aligning ball bearing 18*a* is moved relative to the support base 14*a* in the extension and retraction direction of the piston rod (not shown). Note that the self-aligning ball bearing 18*b* is fixed to the support base 14*b*. The air cylinder 20 is an example of an implementation configuration corresponding to the "fourth actuator" in the present invention.

Figure 4:
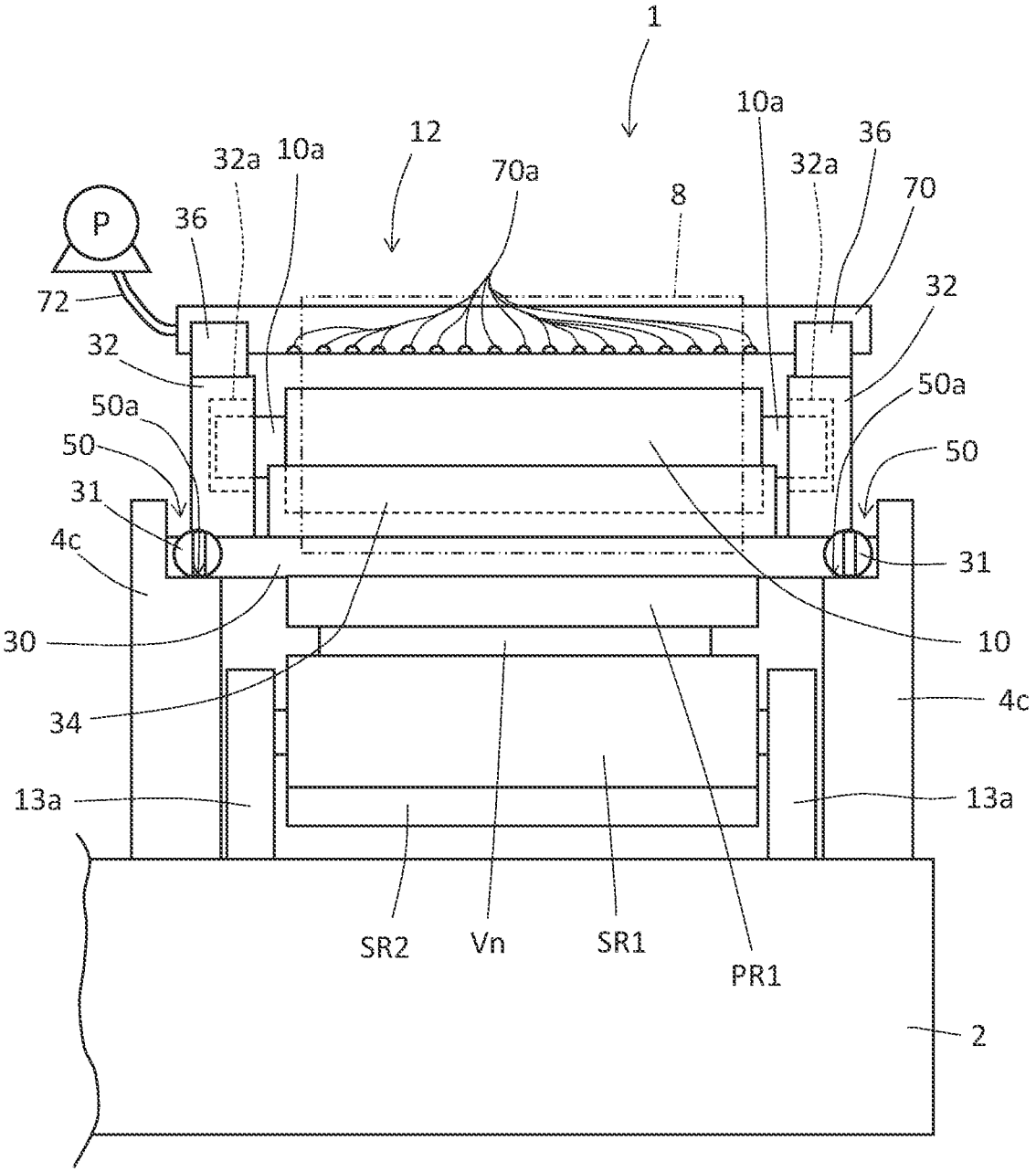
FIG. 4 is an enlarged view of the main part of the polishing apparatus 1 as viewed in an enlarged manner from the direction of arrow C in FIG. 2.

As shown in FIGS. 1 and 3, the support walls 4*c* and 4*c* are arranged separate at a predetermined distance from each other in the extending direction of the beam 4*b*. As shown in FIG. 4, the extending ends of the support walls 4*c* and 4*c* have stepped portions 50 and 50 notched in the directions facing each other. The stepped portions 50 and 50 extend in the direction orthogonal to both the vertical direction and the extending direction of the beam 4*b* (the direction perpendicular to the paper surface in FIG. 4, and the left-right direction in FIG. 5). In other words, it can be said that the stepped portions 50, 50 extend horizontally from a position proximal to the contact roll 8 in a direction away from the contact roll 8. Further, the stepped portions 50 and 50 have horizontal and flat surfaces 50*a* and 50*a*. The surfaces 50*a* and 50*a* extend along the extending direction of the stepped portions 50 and 50.

Figure 5:
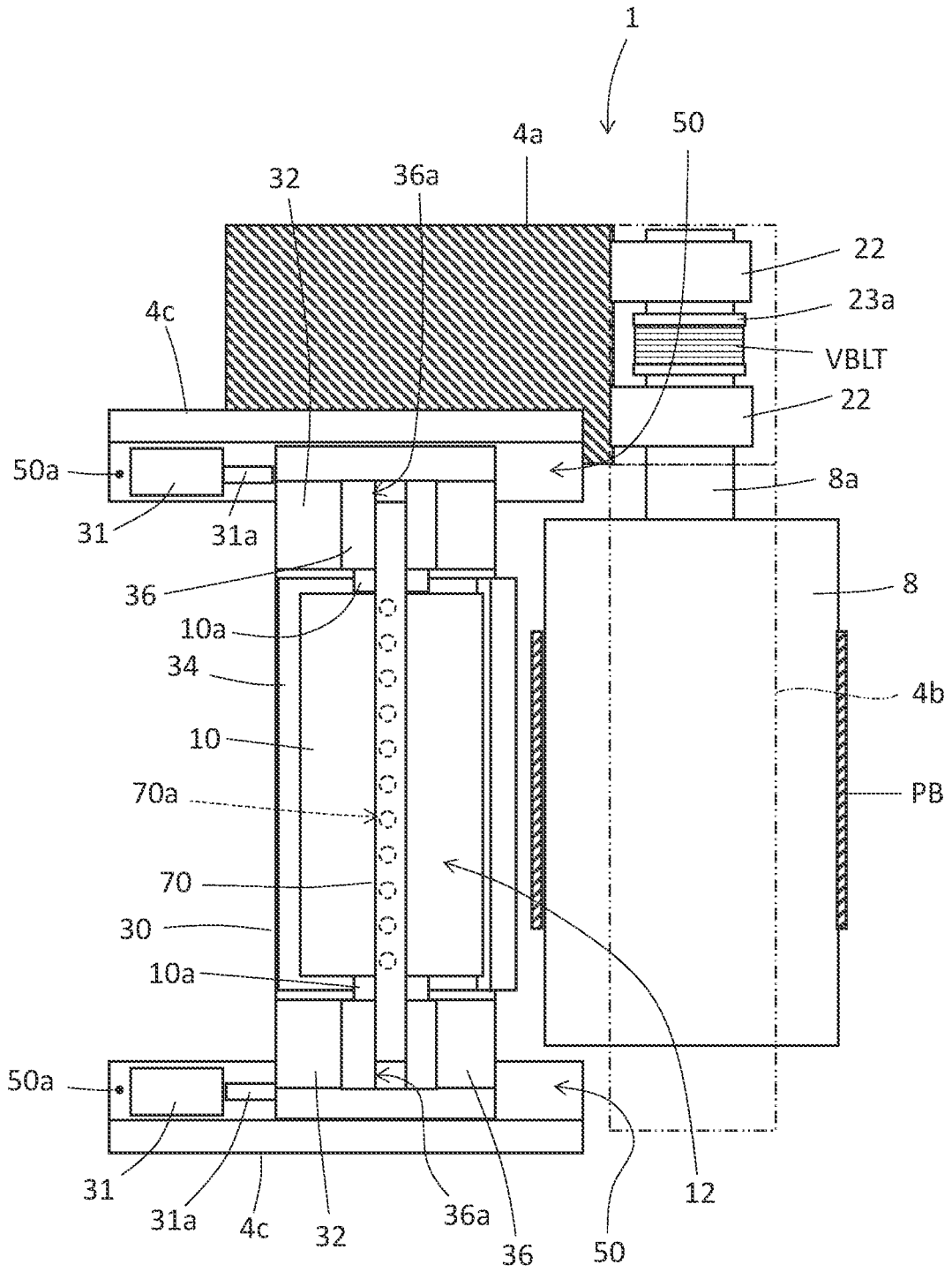
FIG. 5 is a cross-sectional view showing a cross section taken along the E-E of FIG. 2.

As shown in FIGS. 4 and 5, a mounting table 30 is slidably mounted on the surfaces 50*a* and 50*a*, and the air cylinders 31 and 31 are fixed to the surfaces 50*a* and 50*a*. As shown in FIG. 4, the mounting table 30 extends between the support walls 4*c* and 4*c*. To the upper surface of the mounting table 30, supports 32 and 32 having bearings 32*a* and 32*a*, and a later-described drainage receiver 34 of the cleaning water supply device 12 are fixed. The supports 32 and 32 are arranged at positions proximal to both ends of the mounting table 30 in the longitudinal direction (the left-right direction in FIG. 4). In other words, it can be said that the supports 32, 32 are arranged at a predetermined interval in the longitudinal direction of the mounting table 30 (the left-right direction in FIG. 4). The supports 32, 32 are arranged on the mounting table 30 such that the rotation axis centerlines of the bearings 32*a*, 32*a* are parallel to the rotation axis centerline of the contact roll 8. The bearings 32*a* and 32*a* support the later-described rotary shafts 10*a* and 10*a* of the drain roll 10. That is, the drain roll 10 is rotatably supported by the main frame 4 via the bearings 32*a* and 32*a*. In the configuration, the centerline of the rotation axis of the drain roll 10 is parallel to the centerline of the rotation axis of the contact roll 8. The air cylinder 31 is an example of an implementation configuration corresponding to the "first actuator" in the present invention.

As shown in FIG. 4, pipe support 36 and 36 are fixed to the upper surfaces of the supports 32 and 32. As shown in FIG. 5, the pipe support 36 and 36 include receiving portions 36*a* and 36*a* having an upper surface notched in a concave shape. On the receiving portions 36*a* and 36*a*, a pipe 70, which will be described later, of the cleaning water supply device 12 is placed. The mounting table 30, the support 32, and the pipe support 36 are examples of an implementation configuration corresponding to the "support frame" in the present invention.

As shown in FIG. 5, the air cylinders 31 and 31 are arranged on the side opposite to the side where the contact roll 8 is disposed, with respect to the mounting table 30. The air cylinders 31 and 31 include piston rods 31*a* and 31*a* whose tips are connected to the mounting table 30.

As shown in FIGS. 1 and 3, the upper roll 6 has rotating shafts 6*a* and 6*a*. The rotating shafts 6*a* and 6*a* are supported by the self-aligning ball bearings 18*a* and 18*b*. That is, it can be said that the upper roll 6 is rotatably supported by the main frame 4 via the self-aligning ball bearings 18*a* and 18*b*, and is supported by the main frame 4 so as to be movable in the vertical direction by the slide member 15 and the guide member 5.

The upper roll 6 is supported by the self-aligning ball bearings 18*a* and 18*b*, so that the centerline of the rotation axis becomes parallel to the extending direction of the beam 4*b*. Note that, the extension and retraction of the piston rod (not shown) of the air cylinder 20 causes only the self-aligning ball bearing 18*a* to be moved relative to the support base 14*a* in the extension and retraction direction of the piston rod (not shown), resulting in that one end of the upper roll 6 in the longitudinal direction is moved in a direction (the left-right direction in FIG. 2) orthogonal to both the longitudinal direction of the upper roll 6 and the vertical direction. That is, in the horizontal plane, the upper roll 6 is configured to be switched between a state in which the centerline of the rotation axis is parallel to the extending direction of the beam 4*b* and a state in which the centerline of the rotation axis intersects the extending direction of the beam 4*b*. Here, the upper roll 6 is an example of an implementation configuration corresponding to the "third roll" in the present invention. The embodiment in which the upper roll 6 is movably supported in the vertical direction with respect to the main frame 4 via the self-aligning ball bearings 18*a* and 18*b* is an example of the implementation configuration corresponding to "the third roll is supported by the frame body so as to be movable in the direction toward and away from the first roll" in the present invention. Further, the embodiment in which one end of the upper roll 6 in the longitudinal direction is moved in a direction (the left-right direction in FIG. 2) orthogonal to both the longitudinal direction of the upper roll 6 and the vertical direction is an example of an implementation configuration corresponding to "the third roll is supported by the frame body such that one end thereof in the longitudinal direction is movable in a first direction that is orthogonal to both the longitudinal direction and the vertical direction" in the present invention.

As shown in FIG. 3, the contact roll 8 has a rotation shaft 8*a*. The rotating shaft 8*a* is supported by a pair of bearings 22 and 22 fixed to a side surface of the main wall 4*a*. That is, it can be said that the contact roll 8 is rotatably supported by the main frame 4 via the bearings 22 and 22. The bearings 22 and 22 are mounted to the side surface of the main wall 4*a* such that their axis centerlines become parallel to the axis centerlines of the self-aligning ball bearings 18*a* and 18*b* (the rotary axis centerlines of the upper roll 6) and also the straight line between the axis centers of the bearings 22 and 22 and the axis center of the self-aligning ball bearings 18*a* and 18*b* (rotary axis of the upper roll 6) become parallel to the vertical direction when the polishing apparatus 1 is viewed from one side in the extending direction of the axis centerlines of the bearings 22 and 22 (see FIG. 2). As a result, the contact roll 8 and the upper roll 6 are arranged in parallel, and when the polishing apparatus 1 is viewed from one side in the extending direction of the rotation axis centerline of the contact roll 8, the contact roll 8 and the upper roll 6 are arranged in a substantially straight line in the vertical direction. Note that a pulley 23*a* having a V-shaped groove is integrally attached between the bearings 22 and 22 of the rotating shaft 8*a*. In addition, the outer surface of the contact roll 8 is covered with an elastic member 8*b* (see FIG. 2). The contact roll 8 is an example of an implementation configuration corresponding to the "first roll" and the "wound roll" in the present invention.

As shown in FIG. 3, the motor M has a rotating shaft 24. The motor M is fixed to the bed 2 such that the rotation shaft 24 is parallel to the rotation shaft 8*a* of the contact roll 8. A pulley 23*b* having a V-shaped groove is integrally attached to the tip of the rotating shaft 24. An endless V-belt VBLT is hung on both the V-grooved pulley 23*a* on the rotating shaft 8*a* of the contact roll 8 and the V-grooved pulley 23*b* on the rotating shaft 24 of the motor M. As a result, the rotation of the rotation shaft 24 of the motor M is transmitted to the rotation shaft 8*a* of the contact roll 8 via the V-belt VBLT, and thereby the contact roll 8 is rotated.

As shown in FIG. 4, the drain roll 10 has rotating shafts 10*a* and 10*a*. The rotating shafts 10*a* and 10*a* are rotatably supported by bearings 32*a* and 32*a*. That is, the drain roll 10 is rotatably supported by the supports 32 and 32 via the bearings 32*a* and 32*a*. The drain roll 10 is reciprocated, by the shift of the mounting table 30 caused by the air cylinders 31 and 31, between a cleaning position to be in pressure-contact with the contact roll 8 via the abrasive belt PB and a cleaning standby position to be released from the pressure-contact with the contact roll 8 via the abrasive belt PB. Note that, as shown in FIG. 2, the outer surface of the drain roll 10 is covered with an elastic member 10*b*. The drain roll 10 is an example of an implementation configuration corresponding to the "second roll" and the "pressure-contact roll" in the present invention.

As shown in FIG. 4, the cleaning water supply device 12 includes: a pipe 70 having a plurality of discharge ports 70*a*, a pump P connected to the pipe 70 via a conduit 72, and the drainage receiver 34 for receiving the cleaning water from the pipe 70. Of the cleaning water supply device 12, the pipe 70 and the drainage receiver 34 are, together with the drain roll 10, moved in the direction toward the contact roll 8 (the cleaning position) and in the direction away from the contact roll 8 (the cleaning standby position) by the shift of the mounting table 30 caused by the air cylinders 31 and 31. The pipe 70 is an example of an implementation configuration corresponding to the "cleaning liquid supply pipe" in the present invention.

As shown in FIG. 4, the pipe 70 is supported by the pipe supports 36, 36 such that the plurality of discharge ports 70*a* face downward in the vertical direction (the drain roll 10 side). Also, when the pipe 70 is supported by the pipe supports 36, 36, the plurality of discharge ports 70*a* falls within the projection area of the drain roll in a virtual projection plane when the polishing apparatus 1 is viewed from above in the vertical direction. Note that, the pipe 70 is disposed above the drain roll 10 when supported by the pipe supports 36, 36.

As shown in FIGS. 4 and 5, the drainage receiver 34 is disposed between the supports 32 and 32. The drainage receiver 34 is slightly longer than the drain roll 10 in the longitudinal direction (the left-right direction in FIG. 4 and the up-down direction in FIG. 5). Further, as shown in FIG. 5, the drainage receiver 34 has such a size (a projected area) that the drain roll 10 falls within the projection area of the drainage receiver 34 in a virtual projection plane when the polishing apparatus 1 is viewed from above in the vertical direction. As shown in FIG. 1, a tube Tub for draining the cleaning water is connected to the bottom surface of the drainage receiver 34.

As shown in FIG. 2, the support roll SR2 is disposed below the contact roll 8 in the vertical direction so as to face the contact roll 8. The support roll SR2 and the contact roll 8 have a gap therebetween, through which a processed material Vn such as plywood can pass. The gap can be set to be slightly smaller than the thickness of the processed material Vn such as plywood.

As shown in FIG. 2, the support rolls SR1 and SR3 are arranged on both sides of the support roll SR2 in the transport direction (the left-right direction in FIG. 2) of a processed material Vn such as plywood. The support rolls SR1 and SR3 are rotationally driven by a motor (not shown).

Next, the operations of the polishing apparatus 1 configured as described above, particularly the operations to clean the abrasive belt PB will be described. In order to polish a processed material Vn such as plywood by the polishing apparatus 1, first, an abrasive belt PB is attached to the polishing apparatus 1. To attach the abrasive belt PB to the polishing apparatus 1, first, the air cylinders 16 and 16 are driven in the direction in which the piston rods 16*a* and 16*a* retract. As a result, the upper roll 6 supported by the support bases 14*a* and 14*b* via the self-aligning ball bearings 18*a* and 18*b* is moved in a direction toward the upper surface of the beam 4*b*, that is, in the direction approaching the contact roll 8, resulting in reduction of the distance between the centerline of the rotation axis of the upper roll 6 and the centerline of the rotation axis of the contact roll 8. At this point of time, the air cylinders 31 and 31 are driven in the direction in which the piston rod 31*a* retracts, so as to move the drain roll 10 to the cleaning standby position.

In the above-described state, the abrasive belt PB is hung on both the upper roll 6 and the contact roll 8. After that, the air cylinders 16 and 16 are driven in the direction in which the piston rods 16*a* and 16*a* extend. As a result, the upper roll 6 is moved upward in the vertical direction together with the self-aligning ball bearings 18*a* and 18*b* and the support bases 14*a* and 14*b*, resulting in increase of the distance between the rotation axis centerline of the upper roll 6 and the rotation axis centerline of the contact roll 8. When a predetermined tension is applied to the abrasive belt PB, the driving of the air cylinders 16 and 16 is continued so that the state (a state in which the predetermined tension is applied to the abrasive belt PB) is maintained. At this point of time, the air cylinders 31 and 31 are driven in the direction in which the piston rod 31*a* extends, so as to move the drain roll 10 to the cleaning position. In this way, the attachment of the abrasive belt PB onto the polishing apparatus 1 is completed.

Subsequently, the motor M is driven. The driving of the motor M causes the rotating shaft 24 to rotate, and the rotation of the rotating shaft 24 is transmitted to the contact roll 8 via the V-belt VFLT. As a result, the contact roll 8 rotates clockwise in FIG. 2. The rotation of the contact roll 8 causes the abrasive belt PB to rotate clockwise in FIG. 2. At this point of time, the upper roll 6 is driven and rotated by the abrasive belt PB.

Meanwhile, the drain roll 10 is moved to the cleaning position to be in pressure-contact with the contact roll 8 via the abrasive belt PB. As a result, the drain roll 10 is driven counterclockwise in FIG. 2. In this state, the pump P of the cleaning water supply device 12 is driven, so that the cleaning water CW is supplied from the plurality of discharge ports 70*a* of the pipe 70 to the outer surface of the drain roll 10. In this way, the preparation for starting polishing work is completed. The cleaning water CW is an example of an implementation configuration corresponding to the "cleaning liquid" in the present invention.

When the preparation for starting polishing work is completed, a motor (not shown) is then driven to rotate the support rolls SR1 and SR2 (clockwise in FIG. 2). Next, a processed material Vn such as plywood is inserted between the support roll SR1 and the presser roll PR1. As a result, the processed material Vn is conveyed from left to right in FIG. 2, and when it passes between the contact roll 8 and the support roll SR2, its surface is polished by the abrasive belt PB wound around the contact roll 8.

At the point of time, polishing debris, which has been generated by polishing the processed material Vn, adheres to the surface (abrasive surface) of the abrasive belt PB. However, in the polishing apparatus of the present embodiment, when the abrasive belt PB having the polishing debris stuck thereon passes through the contact portion 90 between the drain roll 10 and the abrasive belt PB, the polishing water CW stuck to the outer surface of the drain roll 10 is used to wash away the polishing debris from the surface (abrasive surface) of the abrasive belt PB.

Here, the polishing apparatus 1 of the present embodiment is configured to supply the cleaning water CW from the plurality of discharge ports 70*a* to the outer surface of the drain roll 10, and thereby the cleaning water CW spreads planarly and evenly on the outer surface of the drain roll 10. That is, on the outer surface of the drain roll 10, the cleaning water adheres to at least the portion located, in the rotation direction of the drain roll 10, downstream the dropping position of the cleaning water CW through the plurality of discharge ports 70*a*, sufficiently and evenly over the longitudinal direction of the drain roll 10, along with the rotation of the drain roll 10.

Most of the cleaning water CW stuck to the outer surface of the drain roll 10 is carried, while remaining on the outer surface of the drain roll 10, to the contact portion 90 between the drain roll 10 and the abrasive belt PB (see FIG. 2). Therefore, it is believed that the surface (abrasive surface) of the abrasive belt PB can be effectively and evenly cleaned. This makes it possible to further improve the polishing effect. Since the improvement is achieved only by supplying the cleaning water from the plurality of discharge ports 70*a* to the outer surface of the drain roll 10, the configuration is simple. As a prerequisite, the cleaning water CW carried to the contact portion 90 is well prevented from passing through the contact portion 90 by pressure-contact between the drain roll 10 via the abrasive belt PB and the contact roll 8 via the abrasive belt PB. Thus, it is possible to well decrease the chance that a processed material is polished by the abrasive belt PB having the cleaning water stuck thereto.

Further, since the outer surface of the drain roll 10 and the outer surface of the contact roll 8 are coated with elastic members 8*b* and 10*b*, respectively, it is believed that the cleaning water CW easily enters into between the abrasive grains of the surface (abrasive surface) of the abrasive belt PB due to the elastic deformation of the elastic members 8*b* and 10*b*. As a result, it is believed that the surface (abrasive surface) of the abrasive belt PB can be cleaned more effectively. Note that the cleaning water CW that has entered into between the abrasive grains is sufficiently scraped out by the elastic member 10*b* that is elastically deformed and enters into between the abrasive grains, and thereby the cleaning water CW can be effectively prevented from remaining on the surface (abrasive surface) of the abrasive belt PB.

Further, the polishing apparatus 1 of the present embodiment has a configuration in which the pipe 70 is disposed directly above the drain roll 10. Thus, the cleaning water CW can be sufficiently and evenly supplied to the surface (abrasive surface) of the abrasive belt PB only by dropping the cleaning water from the plurality of discharge ports 70*a*. Thus, the pressure and amount of the cleaning water to be discharged can be reduced as compared with the case with a configuration in which the cleaning water CW is sprayed onto the abrasive belt PB and/or the drain roll 10. As a result, the capacity of the pump P can be reduced, and the pump P can be downsized. In addition, since the amount of the cleaning water used can be reduced, economic efficiency can be improved.

As described above, the abrasive surface washed with the cleaning water CW is pressed against and contacted with the processed material Vn again by the rotation of the abrasive belt PB, and the surface of the processed material Vn is polished, so that a good processing state ca be maintained. In this way, the processed material Vn whose surface has been polished is further conveyed to the right in FIG. 2 and discharged from between the support roll SR3 and the press roll PR2.

The cleaning water CW that washed the abrasive surface or did not adhere to the outer surface of the drain roll 10 goes into the drainage receiver 34, and then foreign substances such as polishing debris were removed from the water by a filter (not shown). After that, the water is sent to the pump P again. In this way, the cleaning water CW is reused for resource saving.

While the polishing work by the abrasive belt PB is continued, the abrasive belt PB may be positionally displaced in the longitudinal direction of to the upper roll 6 (the left-right direction in FIG. 1), due to friction between the abrasive belt PB and the contact roll 8 generated during the polishing and/or due to vibration caused by the operation of the polishing apparatus 1, and the like. In the present embodiment, the displacement of the abrasive belt PB is detected by sensors 60*a* and 60*b* and is corrected by driving the air cylinder 20 (see FIG. 1).

As shown in FIG. 1, the sensors 60*a* and 60*b* are arranged to sandwich therebetween one side edge PBs1 of the abrasive belt PB in a direction (the left-right direction in FIG. 1) orthogonal to the traveling direction (the up-down direction in FIG. 1) of the abrasive belt PB. In other words, it can be said that the side edge PBs1 of the abrasive belt PB, which is in a state with no positional displacement, passes between the sensors 60*a* and 60*b*.

Thus, when both the sensors 60*a* and 60*b* detect the abrasive belt PB, a control device (not shown) determines that the abrasive belt PB has been positionally displaced and moved to the left side (the side edge PBs1 side) in FIG. 1. In contrast, when neither the sensors 60*a* or 60*b* detect the abrasive belt PB, the control device (not shown) determines that the abrasive belt PB has been positionally displaced and moved to the right side (the side edge PBs2 side) in FIG. 1.

Then, when the abrasive belt PB has been moved to the left side (the side edge PBs1 side) in FIG. 1, the control device drives a piston rod (not shown) of the air cylinder 20 to extend and retract such that the abrasive belt PB is moved to the right side, that is, the apparent circumference of the abrasive belt PB on the side edge PBs2 side becomes longer than the apparent circumference on the side edge PBs1 side (the left side in FIG. 1). When only the sensor 60*b* remains to detect the abrasive belt PB, the control device stops driving the air cylinder 20.

Further, when the abrasive belt PB has been moved to the right side (the side edge PBs2 side) in FIG. 1, the control device drives the piston rod of the air cylinder 20 to extend and retract such that the abrasive belt PB is moved to the left side, that is, the apparent circumference of the abrasive belt PB on the side edge PBs1 side becomes longer than the apparent circumference on the side edge PBs2 side (the right side in FIG. 1). When only the sensor 60*b* remains to detect the abrasive belt PB, the control device stops driving the air cylinder 20.

In this way, while the abrasive belt PB is rotating (running), the above-mentioned operations are repeated, so that the abrasive belt PB is maintained to be hung on the upper roll 6 and the contact roll 8 in an appropriate positional relationship.

In the present embodiment, the rotating shafts 6*a* and 6*a* of the upper roll 6 are supported by the self-aligning ball bearings 18*a* and 18*b*. Thus, when the piston rod (not shown) of the air cylinder 20 is driven to extend and retract, the axis centerlines of the shafts 6*a* and 6*a* and the axis centerlines of the self-aligning ball bearings 18*a* and 18*b* coincide with each other. Accordingly, the upper roll 6 does not fail to rotate.

According to the polishing apparatus 1 of the first example of the present invention described above, in order to supply the cleaning water CW to the outer surface of the drain roll 10 from the pipe 70 arranged directly above the drain roll 10, the cleaning water CW adheres planarly and evenly to the outer surface in the longitudinal direction, along with the rotation of the drain roll 10. The cleaning water CW sufficiently stuck to the outer surface of the drain roll 10 is carried to the contact portion 90 between the drain roll 10 and the abrasive belt PB, and cleans the abrasive surface of the abrasive belt PB. Accordingly, it is possible to well reduce the occurrence of uneven cleaning on the surface. Thereby, the polishing effects of the polishing apparatus 1 can be further improved.

Since supplying the cleaning water CW from the plurality of discharge ports 70*a* to the outer surface of the drain roll 10 is all that is needed, the configuration is simple. Further, since the cleaning water CW can be sufficiently and evenly supplied to the abrasive surface only by dropping cleaning water from a plurality of discharge ports 70*a*, the pressure and amount of the cleaning water to be discharged can be reduced as compared with the case with a configuration in which the cleaning water CW is sprayed onto the abrasive belt PB and/or the drain roll 10. As a result, the capacity of the pump P can be reduced, and the pump P can be downsized. In addition, since the amount of the cleaning water CW used can be decreased, economic efficiency can be improved.

Furthermore, since the upper roll 6 is configured to move in the vertical direction and in the direction orthogonal to both the vertical direction and the longitudinal direction of the beam 4*b*, it is necessary to press the drain roll 10 against and contact with the contact roll 8. However, it is not necessary to arrange the cleaning water supply device 12 in the narrow space between the contact roll 8 and a processed material Vn, and thereby the degree of freedom in the arrangement of the cleaning water supply device 12 can be improved.

As described above, the cleaning water CW supplied to the abrasive surface can be well prevented from passing through the contact portion 90 between the drain roll 10 and the abrasive belt PB by the pressure-contact between the drain roll 10 and the contact roll 8 via the abrasive belt PB. Thus, it is possible to sufficiently decrease the chance that a processed material is polished by the abrasive belt PB having the cleaning water stuck thereto.

According to the polishing apparatus 1 of the first example of the present invention, since the drain roll 10, the pipe 70, and the drainage receiver 34 are set on the mounting table 30, the drain rolls 10, the pipe 70, and the drainage receiver 34 can be integrated as a unit. That is, the unit of the unitized drain roll 10, the pipe 70, and the drainage receiver 34 can be assembled easily to the polishing apparatus 1 that does not have the function for cleaning the abrasive belt PB.

According to the polishing apparatus 1 of the first embodiment of the present invention, since the contact roll 8 is used as a backup roll of the drain roll 10, the necessity of a dedicated roll only for backing up the drain roll 10 is eliminated. This avoids an increase in the number of components.

Further, according to the polishing apparatus 1 of the first embodiment of the present invention, the upper roll 6 is disposed above the contact roll 8 in the vertical direction, and the upper roll 6 is moved in the vertical direction to adjust the tension of the abrasive belt PB. This configuration can avoid the size of the polishing apparatus 1 from increasing in the transport direction of a processed material Vn (the horizontal direction, and the left-right direction in FIG. 2) and in the direction (the direction perpendicular to the paper surface of FIG. 2) orthogonal to both the transport direction (the horizontal direction, and the left-right direction in FIG. 2) and the vertical direction (the up-down direction in FIG. 2).

Further, according to the polishing apparatus 1 of the first embodiment of the present invention, the elastic members 8*b* and 10*b* cover the outer surface of the drain roll 10 and the outer surface of the contact roll 8, respectively. Thereby, it is believed that the elastic deformation of the elastic members 8*b* and 10*b* facilitates the entrance of the cleaning water CW into between the abrasive grains on the abrasive surface of the abrasive belt PB. As a result, it is believed that the abrasive surface can be cleaned more effectively. Note that, the cleaning water CW that has entered into between the abrasive grains is sufficiently scraped out by the elastic member 10*b* that is elastically deformed and enters into between the abrasive grains, and thereby it is possible to effectively prevent the cleaning liquid from remaining on the abrasive surface of the abrasive belt.

Example 2

Figure 6:
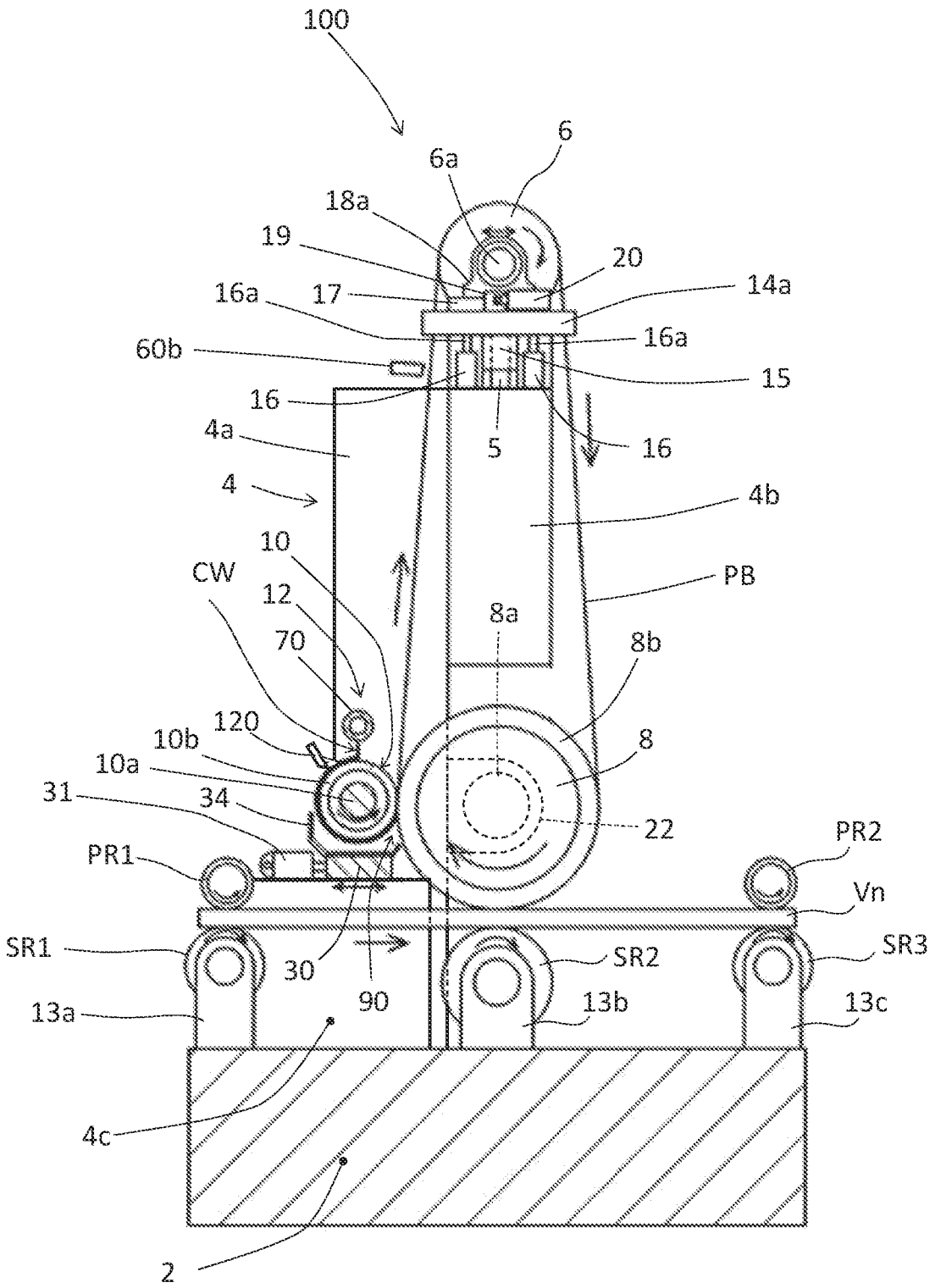
FIG. 6 is a schematic configuration diagram showing the outline of a configuration of a polishing apparatus 100 as a second example of the present invention.

Next, a polishing apparatus 100 of a second embodiment of the present invention will be described. As shown in FIG. 6, the polishing apparatus 100 of the second embodiment has similar configurations to those of the polishing apparatus 1 of the first embodiment, except that the polishing apparatus 100 includes a plate 120 that is in pressure-contact with the drain roll 10, as compared with the polishing apparatus 1 of the first embodiment described with reference to FIG. 1. Thus, in the polishing apparatus 100 of the second embodiment, the same parts as those of the polishing apparatus 1 of the first embodiment are designated by the same reference numerals, and detailed description thereof will be omitted.

Figure 7:
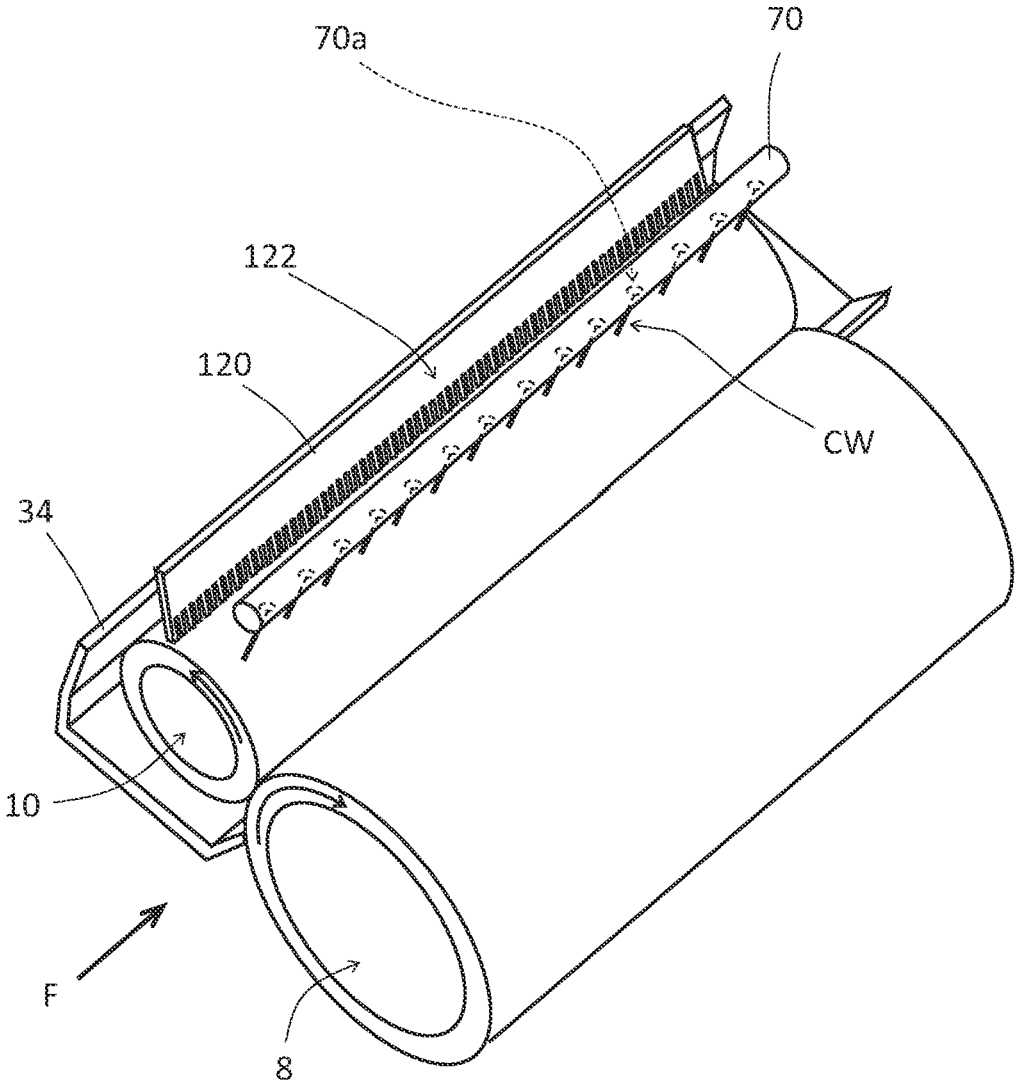
FIG. 7 is a perspective view showing the appearance of a plate 120 and the arrangement relationship of the plate 120 with respect to a drain roll 10 and a pipe 70.
Figure 8:
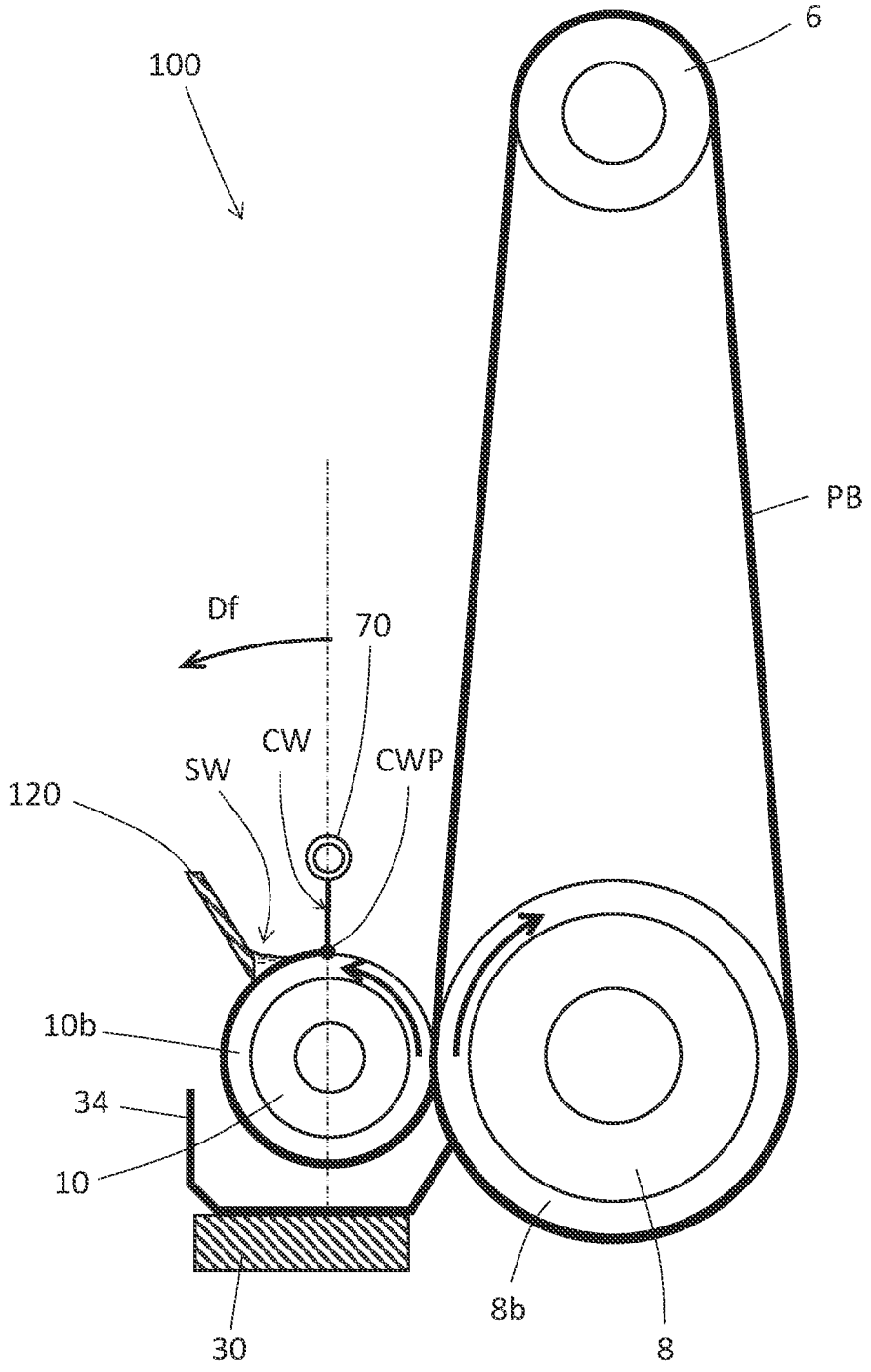
FIG. 8 is an explanatory diagram showing details of the arrangement relationship of the plate 120 with respect to the drain roll 10 and the pipe 70.

As shown in FIG. 7, the plate 120 has substantially the same length as that of the drain roll 10 in the longitudinal direction. The plate 120 has a plurality of slits 122 at the tip thereof. The plurality of slits 122 are arranged at equal intervals along the longitudinal direction of the plate 120. Further, as shown in FIG. 8, the plate 120 is supported by the mounting table 30 so as to lightly contact the outer surface of the contact roll 8, at a position downstream in the rotation direction of the drain roll 10 (the direction of the arrow Df in FIG. 8) with respect to the point CWP where the cleaning water CW supplied from the pipe 70 contacts the outer surface of the drain roll 10. Note that the details of the support of the plate 120 on the mounting table 30 will be omitted. The slits 122 are an example of an implementation configuration corresponding to the "notch" in the present invention. Also, the embodiment, in which the plate 120 is placed supported by the mounting table 30 so as to lightly contact, at the tip portion, the outer surface of the contact roll 8 at a position downstream in the rotation direction of the drain roll 10 (direction of the arrow Df in FIG. 8) with respect to the point CWP, is an example of an implementation configuration corresponding to "the plate is disposed downstream in the rotation direction of the second roll with respect to a position of the projection of the discharge port in the virtual projection plane" in the present invention.

Figure 9:
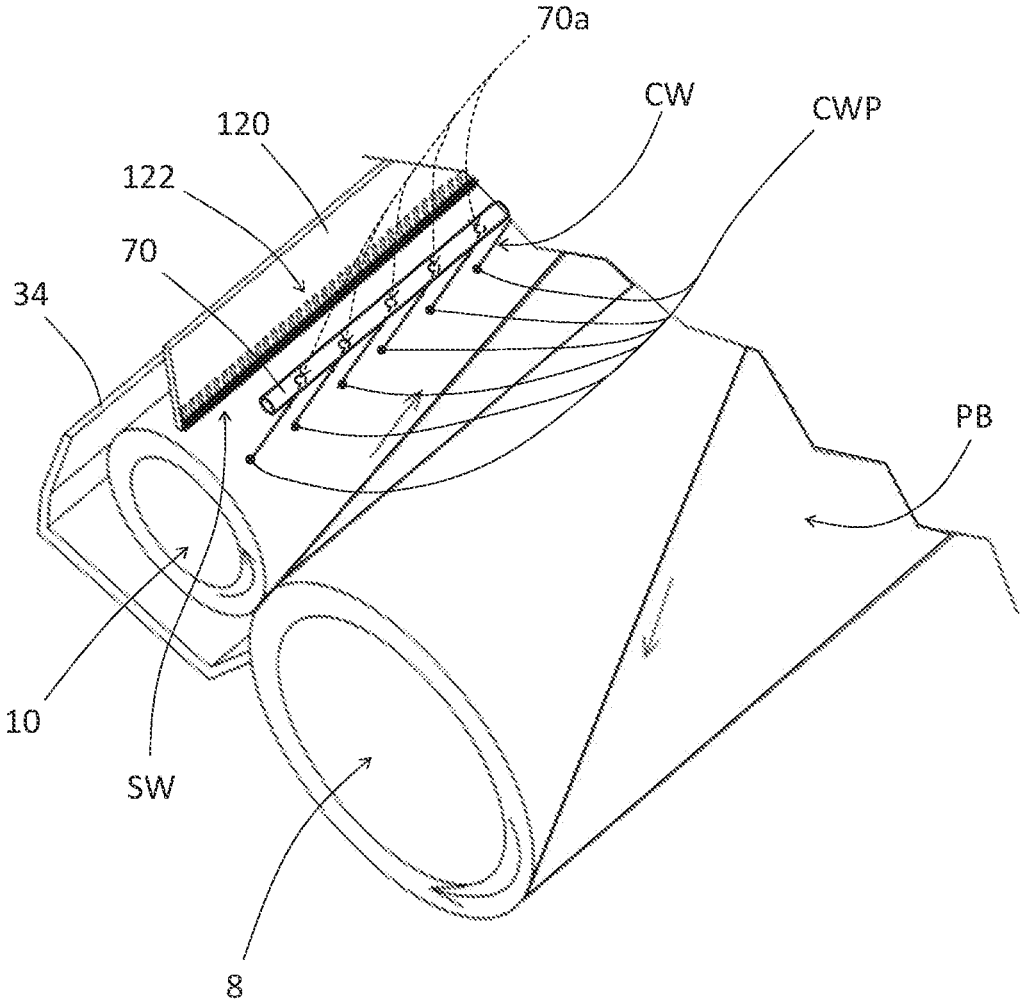
FIG. 9 is an explanatory diagram showing how the cleaning water CW is temporarily stored in the region including the contact portion between the plate 120 and the outer surface of the drain roll 10.

In the polishing apparatus 100 of the second embodiment configured in this way, as shown in FIG. 9, the cleaning water CW, which has been supplied from the plurality of discharge ports 70*a* of the pipe 70 to the outer surface (the point CWP) of the drain roll 10, flows toward the plate 120 by the rotation of the drain roll 10. Then, a part of the cleaning water CW that has flowed to the plate 120 is blocked from flowing further in the rotation direction of the drain roll 10 by the plate 120. That is, the cleaning water CW is temporarily stored in the region (the reference numeral "SW" in FIGS. 8 and 9) including the contact portion between the plate 120 and the outer surface of the drain roll 10. By temporarily storing the cleaning water CW by the plate 120 as described above, the cleaning water CW can be distributed over the entire area in the longitudinal direction of the drain roll 10.

A part of the cleaning water CW supplied from the plurality of discharge ports 70*a* of the pipe 70 to the outer surface (point CWP) of the drain roll 10 flows out through the plurality of slits 120 in the rotation direction of the drain roll 10 and is carried, while adhering to the outer surface of the drain roll 10, to the contact portion 90 between the drain roll 10 and the abrasive belt PB. Here, upstream (rear side) of the drain roll 10 in the rotational direction with respect to the plate 120, the cleaning water CW is stored to be distributed over the entire longitudinal direction of the drain roll 10. As such, a substantially equal amount of cleaning water CW flows out through each of the slits 122. Further, since the plurality of slits 120 are arranged at equal intervals in the longitudinal direction of the plate 120, it is possible to well reduce the occurrence of variation in the amount of the cleaning water CW to adhere to the drainer roll 10 in the longitudinal direction. As a result, the cleaning water CW can be caused to adhere to the outer surface of the drain roll 10 almost uniformly, so that a substantially uniform amount of cleaning water can be supplied to the contact portion 90 over the extending direction. Thus, cleaning away can be achieved. It is possible to further reduce the occurrence of uneven cleaning on the abrasive belt PB.

Example 3

Figure 10:
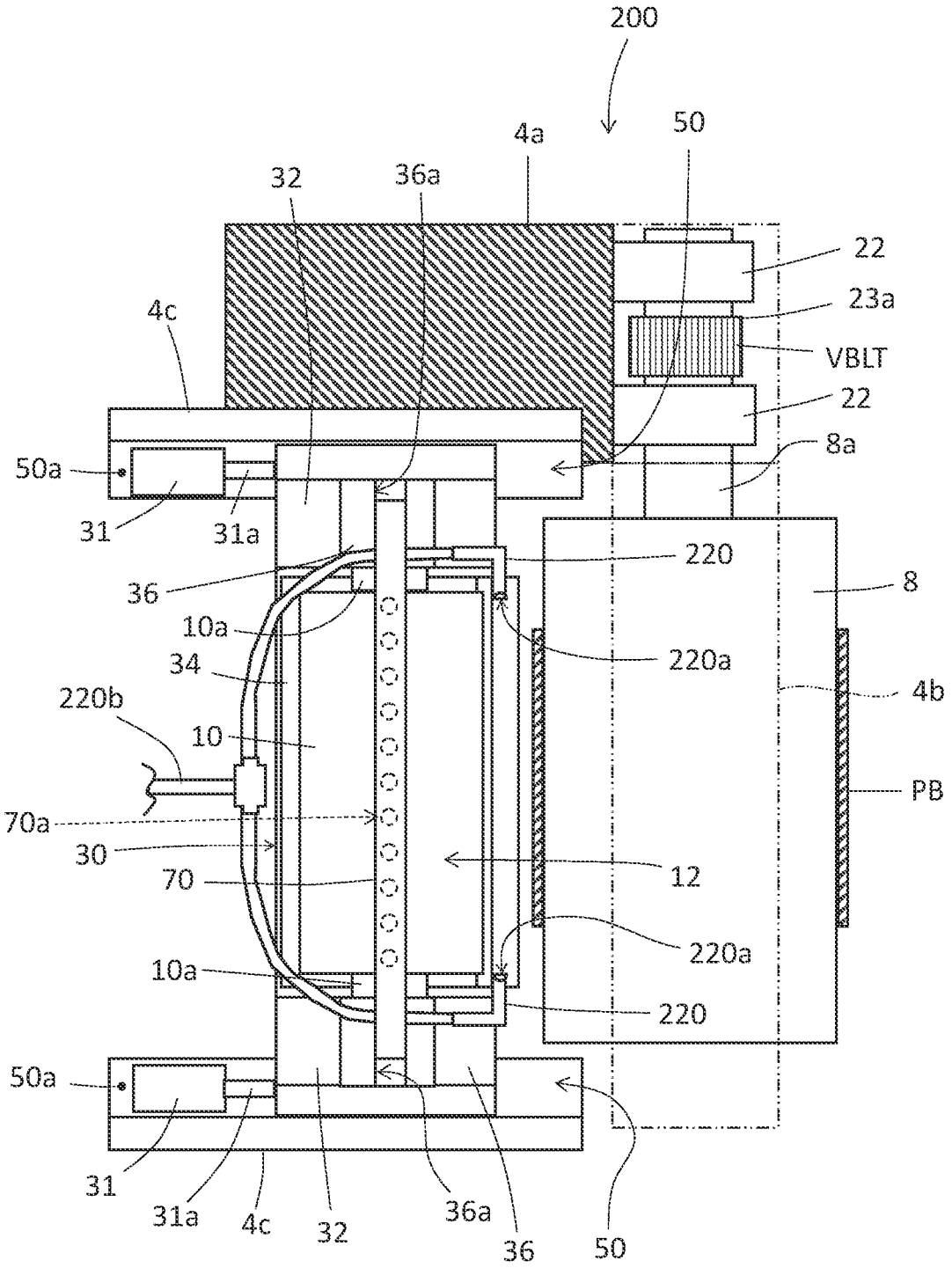
FIG. 10 is an explanatory diagram showing the arrangement of air nozzles 220 and 220 in a polishing apparatus 200 as a third example of the present invention.

Next, a polishing apparatus 200 of a third embodiment of the present invention will be described. As shown in FIG. 10, the polishing apparatus 200 of the third embodiment has similar configurations to those of the polishing apparatus 1 of the first embodiment, except that the polishing apparatus 200 includes air nozzles 220 and 220, as compared with the polishing apparatus 1 of the first embodiment described with reference to FIG. 1. Thus, in the polishing apparatus 200 of the third embodiment, the same parts as those of the polishing apparatus 1 of the first embodiment are designated by the same reference numerals, and detailed description thereof will be omitted.

Figure 11:
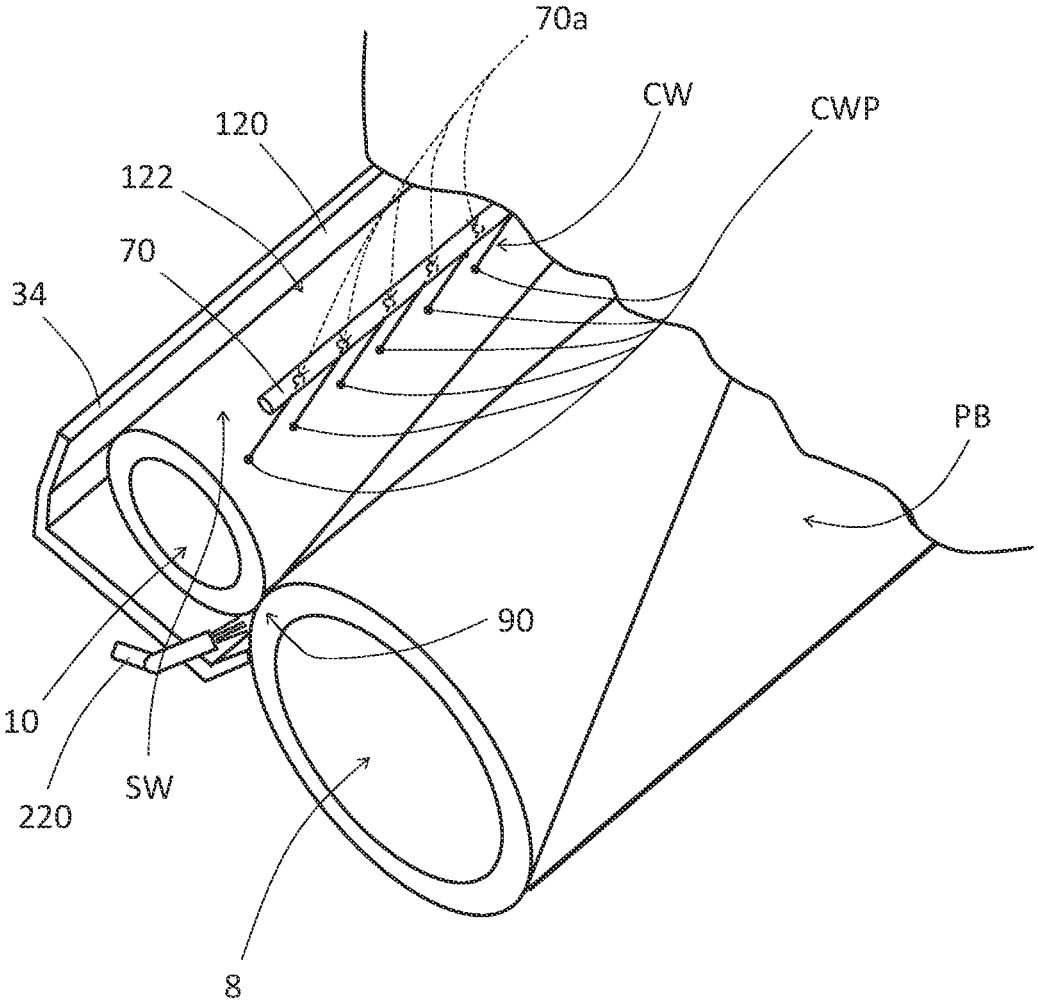
FIG. 11 is a perspective view showing a state in which air is blown into the vicinity of the contact portion 90 between the drain roll 10 and the contact roll 8 by the air nozzles 220 and 220.
Figure 12:
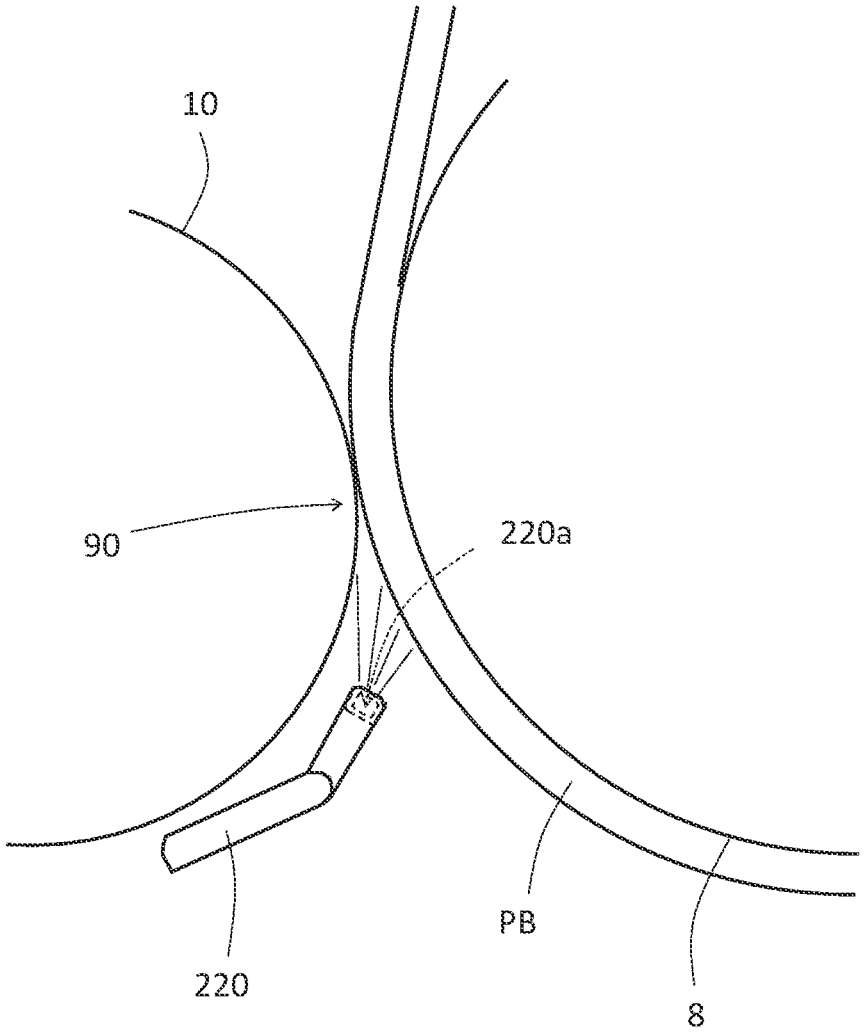
FIG. 12 is an enlarged explanatory view showing, in an enlarged manner, a state in which air is blown into the vicinity of the contact portion 90 between the drain roll 10 and the contact roll 8 by the air nozzles 220 and 220.

As shown in FIG. 10, the air nozzles 220 and 220 have air discharge openings 220*a* and 220*a*. The air nozzles 220 and 220 are connected to an air pump (not shown) via a pipe 220*b*. The air nozzles 220 and 220 are arranged in the vicinity of both ends of the drain roll 10 in the longitudinal direction. As shown in FIGS. 11 and 12, the air discharge openings 220*a* and 220*a* are directed toward the center of the extending direction (same as the longitudinal direction of the draining roll 10) of the contact portion 90 between the drain roll 10 and the abrasive belt PB. In other words, it can be said that the air nozzles 220 and 220 are supported by the mounting table 30 (FIG. 10) in a state that the air discharge openings 220*a* and 220*a* face each other.

In the polishing apparatus 200 of the third embodiment having the above-described configuration, when the cleaning water CW is supplied from the plurality of discharge ports 70*a* of the pipe 70 to the outer surface (at the point CWP) of the drain roll 10, an air pump (not shown) is driven so that air is discharged from the air discharge openings 220*a*, 220*a* of the air nozzles 220, 220. As a result, it is possible to well decrease the scattering of the cleaning water CW to the outside the contact portion 90, that is, away from the extending direction of the contact portion 90, wherein the cleaning water CW has been supplied to the outer surface of the draining roll 10 and carried to the contact portion 90 between the draining roll 10 and the abrasive belt PB while adhering to the outer surface of the draining roll 10.

In the first example, the second example, and the third example, the contact roll 8 is used as a backup roll of the drain roll 10, but the present invention is not limited to this configuration. For example, the upper roll 6 may be used as a backup roll for the drain roll 10 in a configuration in which the upper roll 6 does not move relative to the beam 4*b*, that is, the upper roll 6 reciprocates in the vertical direction (the up-down direction in FIG. 2), or one end of the upper roll 6 in the longitudinal direction does not reciprocate in the direction orthogonal to both the longitudinal direction and the vertical direction (the left-right direction in FIG. 2). Further, as shown in the polishing apparatus 300 of a modified example illustrated in FIG. 13, a configuration is possible in which a dedicated backup roll 380 for backing up the drain roll 10 is installed.

Figure 13:
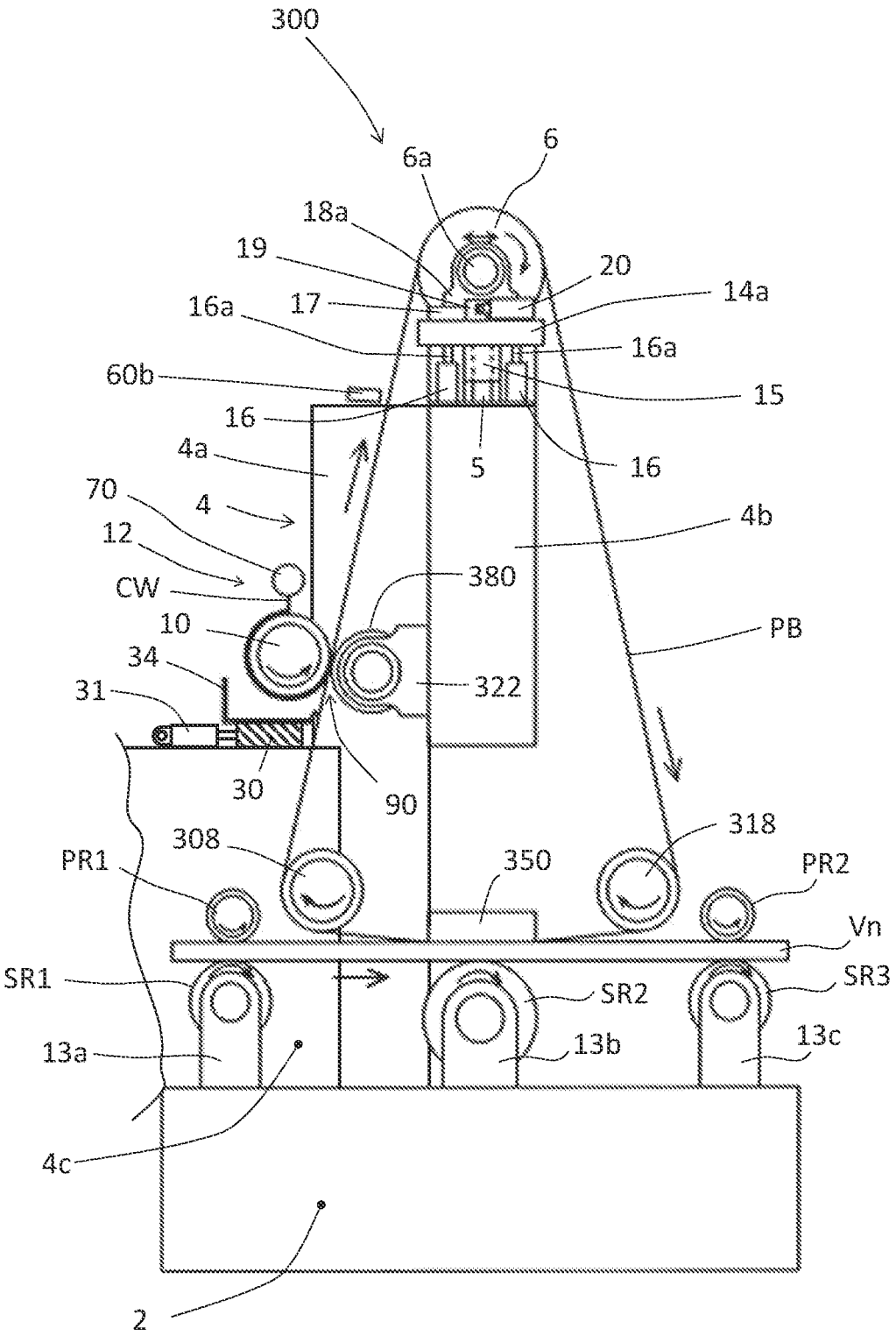
FIG. 13 is a schematic configuration diagram showing the outline of a configuration of a polishing apparatus 300 of the modified example.

In this case, as shown in FIG. 13, a configuration is possible in which the backup roll 380 is rotatably supported by the beam 4*b* via the bearing 322, and the shapes of the support walls 4*c* and 4*c*, the mounting table 30, and the supports 32 and 32 are changed, so that the drainer roll 10 can be pressed against and contacted with the backup roll 380 via the abrasive belt PB. As described above, in the polishing apparatus 300 of a modified example as compared with the polishing apparatus 1 of the first embodiment, the draining roll 10 can be pressed against and contacted with the backup roll 380 via the abrasive belt PB. In addition, as shown in FIG. 13, the contact roll 8 is replaced with the driving roll 308 and the driven roll 318, and a pressurizing member 350 is added to press the abrasive belt PB against the surface of the processed material Vn, as compared with the polishing apparatus 1 of the first embodiment. Except for these points, the polishing apparatus 300 of a modified example has basically a similar configuration to that the polishing apparatus 1 of the first embodiment described with reference to FIG. 1. Thus, the same parts as those of the polishing apparatus 1 of the first embodiment of the polishing apparatus 300 of the modified example are designated by the same reference numerals, and detailed description thereof will be omitted.

In the first example, the second example, and the third example, the pipe 70 is disposed above the drain roll 10. Specifically, the plurality of discharge ports 70*a* are arranged to be within the projection area of the drain roll 10 in a virtual projection plane when the polishing apparatus 1 is viewed from above in the vertical direction, but the present invention is not limited to this configuration. The pipe 70 may be in any arrangement as long as the cleaning liquid CW can be supplied to the outer surface of the upper 6: for example, a configuration is possible in which the pipe 70 is disposed on the side opposite the contact roll 8 (just beside the drain roll 10) with respect to the drain roll 10.

In the first example, the second example, and the third example, the drain roll 10, the pipe 70, and the drainage receiver 34 are able to be reciprocated between the cleaning position and cleaning standby position, but the present invention is not limited to this configuration. For example, a configuration is possible in which only one of the drain roll 10, the pipe 70, and the drainage receiver 34 is reciprocated between the cleaning position and cleaning standby position. Alternatively, all of the drain roll 10, the pipe 70, and the drainage receiver 34 may be secured to the cleaning standby position.

In the first example, the second example, and the third example, the contact roll 8 and the upper roll 6 are arranged in a substantially straight line in the vertical direction, but the present invention is not limited to this configuration. The contact roll 8 and the upper roll 6 are in any positional relationship with each other: for example, a configuration is possible in which the contact roll 8 and the upper roll 6 are arranged in a substantially straight line in the extending direction of a straight line that is at an angle to the vertical direction. Alternatively, the contact roll 8 and the upper roll 6 may be arranged in a substantially straight line in the horizontal direction.

In the first example, the second example, and the third example, the upper roll 6 is relatively moved with respect to the beam 4*b* in order to generate tension in the abrasive belt PB, but the present invention is not limited to this configuration. For example, a configuration is possible in which a dedicated roll for generating tension in the abrasive belt PB is used.

In the first example, the second example, and the third example, one end of the upper roll 6 in the longitudinal direction is relatively moved with respect to the beam 4*b* so as to correct the displacement of the abrasive belt PB (the positional displacement in the longitudinal direction of the upper roll 6). However, the present invention is not limited to the configuration. For example, a configuration is possible in which a dedicated mechanism for correcting the displacement of the abrasive belt PB is separately mounted.

In the first example, the second example, and the third example, the abrasive belt PB is rotated only by the two rolls of the contact roll 8 and the upper roll 6, but the number of rolls around which the abrasive belt PB is wound may be one, or three, or more.

The present embodiment shows an example of an embodiment for carrying out the present invention. Therefore, the present invention is not limited to the configuration of the present embodiment. The correspondence between each element of the present embodiment and each element of the present invention is shown below.

REFERENCE SIGNS LIST

1 Polishing apparatus (Polishing apparatus)
2 Bed
4 Main frame (Frame body)
4*a* Main wall
4*b* Beam
4*c* Support wall
5 Guide member
6 Upper roll (Third roll)
6*a* Rotation axis
8 Contact roll (First roll, contact roll, wound roll)
8*a* Rotation axis
8*b* Elastic member (Elastic member)
10 Drain roll (Second roll, pressure-contact roll)
10*a* Rotation axis
10*b* Elastic member (Elastic member)
12 Cleaning liquid supply device
13*a* Bearing
13*b* Bearing
13*c* Bearing
14*a* Support base
14*b* Support base
15 Slide member
16 Air cylinder (Third actuator)
16*a* Piston rod
17 Linear guide
18*a* self-aligning ball bearing (Self-aligning bearing)
18*b* self-aligning ball bearing (Self-aligning bearing)
19 Coupler
20 Air cylinder (Fourth actuator)
23*a* V-grooved pulley
23*b* V-grooved pulley
24 Rotation axis
30 Mounting table (Support frame)
31 Air cylinder (First actuator)
31*a* Piston rod
32 Support (Support frame)
32*a* Bearing
34 Drainage receiver
36 Pipe support (Support frame)
36*a* Receiving portion
50 Stepped portion
50*a* surface
60*a* Sensor
60*b* Sensor
70 Pipe (Cleaning liquid supply pipe)
70*a* Discharge port
72 Conduit
90 Contact portion (Contact portion)
100 Polishing apparatus (Polishing apparatus)
120 Plate (Plate)
122 Slit (Notch)
200 Polishing apparatus (Polishing apparatus)
220 Air nozzle (Air nozzle)
220*a* Air discharge opening (Air discharge opening)
220*b* Conduit
300 Polishing apparatus (Polishing apparatus)
308 Drive roll
318 Driven roll
350 Pressurizing member
380 Backup roll
VBLT V-belt
M Moter (Second actuator)
SR1 Support roll
SR2 Support roll
SR3 Support roll
PR1 Press roll
PR2 Press roll
Vn Processed material
PB Abrasive belt (Abrasive belt)
PBs1 Side edge
PBs2 Side edge
P Pump (Pump)
Tub Tube
CW Cleaning water (Cleaning liquid)
CWP Point
SW Stored cleaning water

The invention claimed is:

1. A polishing apparatus for polishing a processed material by rotating an endless abrasive belt having an abrasive surface, the polishing apparatus comprising:

a frame body;

a first roll around which the endless abrasive belt is wound with the surface opposite to the abrasive surface of the belt being in pressure-contact with the first roll, the first roll rotatably supported by the frame body;

a second roll around which the abrasive belt is not wound, the second roll disposed to be parallel to the first roll so as to be spaced from the processed material and face the abrasive surface, the second roll rotatably supported by the frame body so as to be in pressure-contact with the first roll via the endless abrasive belt; and a cleaning liquid supply pipe having at least one discharge port for discharging a cleaning liquid, the cleaning liquid supply pipe supported by the frame body such that the discharge port faces the outer surface of the second roll, wherein the cleaning liquid discharged from the at least one discharge port onto the outer peripheral surface of the second roll is carried to a contact portion between the first roll and the second roll as the second roll rotates, and wherein the pressure-contact between the first roll and the second roll prevents the cleaning liquid from passing through the contact portion.

2. The polishing apparatus according to claim 1, wherein the discharge port is disposed above the second roll in the vertical direction and within a projection area of the second roll in a virtual projection plane when the second roll is viewed from above in the vertical direction.

3. The polishing apparatus according to claim 1, further comprising:

a support frame arranged to the frame body so as to be movable in a direction toward and away from the first roll; and a first actuator mechanically connected to the support frame so as to move the support frame in the direction toward and away from the first roll, wherein the second roll is rotatably supported by the support frame.

4. The polishing apparatus according to claim 2, further comprising:

a plate extending in the axial centerline direction of the second roll, the plate having a tip portion in contact with the outer surface of the second roll along the axial centerline direction of the second roll, and the plate disposed downstream in the rotation direction of the second roll with respect to a position of the projection of the discharge port in the virtual projection plane, the tip portion having a plurality of notches, the plurality of notches evenly arranged in the extending direction of the plate.

5. The polishing apparatus according to claim 3, wherein the cleaning liquid supply pipe is supported by the support frame.

6. The polishing apparatus according to claim 4, wherein the plate is supported by the support frame.

7. The polishing apparatus according to claim 1, further comprising:

a third roll disposed to be parallel to the first and second rolls and to be in pressure-contact with the surface opposite to the abrasive surface of the belt, the third roll rotatably supported by the frame body; and a second actuator mechanically connected to at least one of the first and third rolls for rotating at least one of the first and third rolls, wherein by rotating at least one of the first and third rolls, the second actuator rotates the endless abrasive belt wound around the first and third rolls.

8. The polishing apparatus according to claim 7, further comprising:

a third actuator mechanically connected to the third roll, wherein the first roll is a contact roll configured to be in pressure-contact with the processed material via the endless abrasive belt, the third roll is supported by the frame body so as to be movable in the direction toward and away from the first roll, the third actuator is configured to move the third roll in the direction toward and away from the first roll.

9. The polishing apparatus according to claim 7, further comprising:

a fourth actuator mechanically connected to the third roll, wherein the first roll is a contact roll configured to be in pressure-contact with the processed material via the endless abrasive belt, the third roll is supported by the frame body such that one end of the third roll in the longitudinal direction is movable in a first direction orthogonal to both the longitudinal direction and the vertical direction, and the fourth actuator is configured to move, in the first direction, one end of the third roll in the longitudinal direction.

10. The polishing apparatus according to claim 9, wherein the third roll is supported by the frame body via a self-aligning bearing, and the fourth actuator is connected to the third roll via the self-aligning bearing.

11. The polishing apparatus according to claim 7, wherein the third roll is disposed above the first roll in the vertical direction.

12. The polishing apparatus according to claim 1, further comprising:

a cleaning liquid tray disposed, in the vertical direction, below a contact portion between the second roll and the abrasive surface.

13. The polishing apparatus according to claim 1, further comprising:

air nozzles each having an air discharge opening directed toward the center, in the extending direction, of the contact portion between the second roll and the abrasive surface, the air nozzles arranged at both ends of the contact portion in the extending direction.

14. The polishing apparatus according to claim 1, wherein the outer surface of the second roll is covered with an elastic member.

15. A polishing method for polishing a processed material by rotating an endless abrasive belt having an abrasive surface, the polishing method comprising:

(a) rotating the endless abrasive belt;

(b) bringing a second roll into pressure-contact with a first roll via the endless abrasive belt, the second roll around which the endless abrasive belt is not wound, the second roll being disposed downstream in the rotation direction of the endless abrasive belt with respect to the pressure-contact portion between the abrasive surface and the processed material, the second roll disposed to be parallel to the first roll so as to be spaced from the processed material and face the abrasive surface, (c) supplying a cleaning liquid to the outer surface of the second roll, and (d) carrying the cleaning liquid supplied onto the outer peripheral surface of the second roll to a contact portion between the first roll and the second roll as the second roll rotates, preventing the cleaning liquid from passing through the contact portion by the pressure-contact between the first roll and the second roll, and after the endless abrasive belt passes through the contact portion, bringing the endless abrasive belt into pressure-contact with the processed material to polish the processed material.

* * * * *